US008387811B2

(12) United States Patent
Livingston et al.

(10) Patent No.: US 8,387,811 B2
(45) **Date of Patent: *Mar. 5, 2013**

(54) PIERCEABLE CAP HAVING PIERCING EXTENSIONS

(75) Inventors: Dwight Livingston, Fallston, MD (US); Dustin Diemert, Baltimore, MD (US); Ammon David Lentz, York, PA (US)

(73) Assignee: BD Diagnostics, Sparks, MD (US)

( * ) Notice: Subject to any disclaimer, the term of this patent is extended or adjusted under 35 U.S.C. 154(b) by 1387 days.

This patent is subject to a terminal disclaimer.

(21) Appl. No.: 11/979,713

(22) Filed: Nov. 7, 2007

(65) Prior Publication Data

US 2008/0251490 A1 Oct. 16, 2008

Related U.S. Application Data

(63) Continuation-in-part of application No. 11/785,144, filed on Apr. 16, 2007.

(51) Int. Cl.

| | |
|---|---|
| ***B65D 41/50*** | (2006.01) |
| ***B65D 41/32*** | (2006.01) |
| ***B65D 41/20*** | (2006.01) |
| *B01L 3/00* | (2006.01) |
| *A61J 1/05* | (2006.01) |

(52) U.S. Cl. ..... 215/253; 215/247; 215/249; 220/266; 422/570; 604/415

(58) Field of Classification Search ..... 215/250, 215/247, 249, 253, 248; 220/229, 258.3, 220/258.4, 258.5, 266; 604/415; 422/568, 422/570

See application file for complete search history.

(56) References Cited

U.S. PATENT DOCUMENTS

| | | | |
|---|---|---|---|
| 1,413,703 | A | 4/1922 | Biehn |
| 3,460,702 | A | 8/1969 | Andrews |
| 4,259,956 | A | 4/1981 | Ogle |
| 4,418,827 | A | 12/1983 | Butterfield |
| 4,465,200 | A | 8/1984 | Percarpio |
| 4,515,752 | A | 5/1985 | Miramanda |

(Continued)

FOREIGN PATENT DOCUMENTS

| | | |
|---|---|---|
| AU | 4846800 | 12/2000 |
| CA | 2373572 | 11/2000 |

(Continued)

OTHER PUBLICATIONS

International Search Report, PCT/US2008/60349, dated Jun. 9, 2009.

(Continued)

*Primary Examiner* — Robin Hylton

(74) *Attorney, Agent, or Firm* — Lerner, David, Littenberg, Krumholz & Mentlik, LLP

(57) ABSTRACT

A pierceable cap maybe used for containing sample specimens during storage and transport. The pierceable cap may prevent unwanted escape of sample specimen before transfer with a transfer device. The pierceable cap may fit over a vessel. An access port in the pierceable cap may allow passage of a tip of a transfer device though the pierceable cap. Multiple frangible layers maybe disposed across the access port. One or more extensions proximate to a lower frangible layer may rotate around one or more coupling regions during insertion of the transfer device. The movement of the one or more extensions may pierce the lower frangible layer to create airways and allow air to escape from a vessel at a reduced velocity. Upper frangible layers may prevent escape of materials from spaces intermediate between the lower frangible layer and the upper frangible layers.

25 Claims, 16 Drawing Sheets

U.S. PATENT DOCUMENTS 4,576,185 A 3/1986 Proud et al.
4,582,207 A 4/1986 Howard et al.
4,600,112 A 7/1986 Shillington et al.
4,617,941 A 10/1986 Ichikawa et al.
4,664,274 A 5/1987 Konrad
4,665,959 A 5/1987 Takagi
4,673,393 A * 6/1987 Suzuki et al. ..... 604/167.04
4,682,703 A 7/1987 Kasai et al.
4,685,917 A 8/1987 Baldini et al.
4,697,717 A 10/1987 Grippi
4,732,850 A 3/1988 Brown et al.
4,774,963 A 10/1988 Ichikawa et al.
4,811,856 A 3/1989 Fischman
4,815,618 A 3/1989 Gach
4,886,177 A 12/1989 Foster
4,892,222 A 1/1990 Schmidt et al.
4,898,293 A 2/1990 Morel
4,920,976 A 5/1990 Calzi et al.
4,957,637 A 9/1990 Cornell
4,995,521 A 2/1991 von Schuckmann
D315,680 S 3/1991 Baxter
5,024,327 A 6/1991 Shillington
5,033,476 A 7/1991 Kasai
5,036,992 A 8/1991 Mouchawar et al.
5,053,134 A 10/1991 Luderer et al.
5,061,263 A 10/1991 Yamazaki et al.
5,071,017 A 12/1991 Stull
5,084,393 A 1/1992 Rogalsky
5,100,010 A 3/1992 Waters
5,111,946 A 5/1992 Glanz
5,131,777 A 7/1992 Kimura et al.
5,152,277 A 10/1992 Honda et al.
5,165,560 A 11/1992 Ennis, III et al.
5,188,620 A 2/1993 Jepson et al.
5,201,794 A 4/1993 Kasai et al.
5,202,093 A 4/1993 Cloyd
5,275,299 A 1/1994 Konrad et al.
5,279,606 A 1/1994 Haber et al.
5,294,011 A 3/1994 Konrad et al.
5,297,599 A 3/1994 Bucheli
5,306,270 A 4/1994 Macartney et al.
5,308,506 A 5/1994 McEwen et al.
5,326,534 A 7/1994 Yamazaki et al.
5,370,252 A 12/1994 Parsons et al.
5,395,365 A 3/1995 Weiler et al.
D357,985 S 5/1995 Burns
5,433,716 A 7/1995 Leopardi et al.
5,494,170 A 2/1996 Burns
5,501,676 A 3/1996 Niedospial et al.
5,514,339 A 5/1996 Leopardi et al.
5,522,518 A 6/1996 Konrad et al.
5,540,890 A 7/1996 Clark et al.
5,566,859 A 10/1996 Willis et al.
5,595,907 A 1/1997 Kayal et al.
5,611,792 A 3/1997 Gustafsson
5,627,071 A 5/1997 Triva
5,632,396 A 5/1997 Burns
5,637,099 A 6/1997 Durdin et al.
5,658,531 A 8/1997 Cope et al.
5,738,920 A 4/1998 Knors
5,772,652 A 6/1998 Zielinski
5,779,074 A 7/1998 Burns
5,874,048 A 2/1999 Seto et al.
5,915,577 A 6/1999 Levine
5,924,584 A 7/1999 Hellstrom et al.
5,992,660 A 11/1999 Miura et al.
6,001,087 A 12/1999 Zurcher
6,006,931 A 12/1999 Sarstedt
6,012,596 A * 1/2000 Oglesbee et al. ..... 215/261
6,024,235 A 2/2000 Schwab
6,030,582 A 2/2000 Levy
6,054,099 A 4/2000 Levy
6,056,135 A 5/2000 Widman
6,068,150 A 5/2000 Mitchell et al.
6,126,903 A 10/2000 Preston et al.
6,145,688 A 11/2000 Smith
6,170,693 B1 1/2001 Goto
6,234,335 B1 5/2001 Gee et al.
6,255,101 B1 7/2001 Rousseau et al.
6,274,087 B1 8/2001 Preston et al.
6,277,331 B1 8/2001 Konrad
6,286,698 B2 9/2001 Hague et al.
6,361,744 B1 3/2002 Levy
6,375,022 B1 4/2002 Zurcher et al.
D457,247 S 5/2002 Iheme et al.
6,402,407 B1 6/2002 Goldstein
6,406,671 B1 6/2002 DiCesare et al.
6,426,046 B1 7/2002 Cassells et al.
6,475,774 B1 11/2002 Gupta
6,517,782 B1 2/2003 Horner et al.
6,517,783 B2 2/2003 Horner et al.
6,562,300 B2 5/2003 Rosen et al.
6,607,685 B2 8/2003 Naritomi et al.
6,617,170 B2 9/2003 Augello et al.
6,627,156 B1 9/2003 Goodale et al.
6,662,957 B2 12/2003 Zurcher et al.
6,716,396 B1 4/2004 Anderson et al.
6,723,289 B2 4/2004 Iheme et al.
6,752,965 B2 6/2004 Levy
6,806,094 B2 10/2004 Anderson et al.
6,837,954 B2 1/2005 Carano
6,893,612 B2 5/2005 Kacian et al.
6,959,615 B2 11/2005 Gamble
6,994,699 B2 2/2006 Houwaert et al.
7,097,057 B2 8/2006 Classens
7,153,477 B2 12/2006 DiCesare et al.
7,188,734 B2 3/2007 Konrad
2002/0090736 A1 7/2002 Ulin
2002/0127147 A1 9/2002 Kacian et al.
2002/0131902 A1 9/2002 Levy
2002/0132367 A1 9/2002 Miller et al.
2003/0017084 A1 1/2003 Dale et al.
2003/0052074 A1 3/2003 Chang et al.
2003/0053938 A1 3/2003 Szeles
2003/0155321 A1 8/2003 Bauer et al.
2003/0207463 A1 11/2003 Iheme et al.
2003/0215365 A1 11/2003 Sevigny et al.
2004/0013575 A1 1/2004 Stevens et al.
2004/0067169 A1 4/2004 Krause
2004/0076546 A1 4/2004 Bissett
2004/0091401 A1 5/2004 Golabek et al.
2004/0105786 A1 6/2004 Anderson et al.
2004/0150221 A1 8/2004 Brown
2004/0151634 A1 8/2004 Anderson et al.
2004/0152205 A1 8/2004 Anderson et al.
2005/0059161 A1 3/2005 Anderson et al.
2005/0079633 A1 4/2005 Kacian et al.
2005/0281713 A1 12/2005 Hampsch et al.
2006/0057738 A1 3/2006 Hall
2006/0263266 A1 11/2006 DiCesare et al.
2007/0034592 A1* 2/2007 Pavlovic et al. ..... 215/253

FOREIGN PATENT DOCUMENTS

EP 454493 10/1991
EP 513901 11/1992
EP 1183104 3/2002
EP 1495811 A2 1/2005
JP 7051253 2/1995
JP 8103433 4/1996
JP 2002-544076 12/2002
WO WO-99/45360 9/1999
WO WO-00/69389 11/2000
WO 2006108079 A1 10/2006

OTHER PUBLICATIONS

Supplementary European Search Report, EP 08745871, dated Aug. 17, 2010.
European Search Report for Application No. EP 11191354 dated Feb. 13, 2012.

* cited by examiner

PIERCEABLE CAP HAVING PIERCING EXTENSIONS

This application is a continuation-in-part of U.S. Ser. No. 11/785,144, filed Apr. 16, 2007, and entitled "Pierceable Cap", the contents of which are herein incorporated by reference in its entirety.

BACKGROUND OF THE INVENTION

Combinations of caps and vessels are commonly used for receiving and storing specimens. In particular, biological and chemical specimens maybe analyzed to determine the existence of a particular biological or chemical agent. Types of biological specimens commonly collected and delivered to clinical laboratories for analysis may include blood, urine, sputum, saliva, pus, mucous, cerebrospinal fluid and others. Since these specimen-types may contain pathogenic organisms or other harmful compositions, it is important to ensure that vessels are substantially leak-proof during use and transport. Substantially leak-proof vessels are particularly critical in cases where a clinical laboratory and a collection facility are separate.

To prevent leakage from the vessels, caps are typically screwed, snapped or otherwise frictionally fitted onto the vessel, forming an essentially leak-proof seal between the cap and the vessel. In addition to preventing leakage of the specimen, a substantially leak-proof seal formed between the cap and the vessel may reduce exposure of the specimen to potentially contaminating influences from the surrounding environment. A leak-proof seal can prevent introduction of contaminants that could alter the qualitative or quantitative results of an assay as well as preventing loss of material that maybe important in the analysis.

While a substantially leak-proof seal may prevent specimen seepage during transport, physical removal of the cap from the vessel prior to specimen analysis presents another opportunity for contamination. When removing the cap, any material that may have collected on the under-side of the cap during transport may come into contact with a user or equipment, possibly exposing the user to harmful pathogens present in the sample. If a film or bubbles form around the mouth of the vessel during transport, the film or bubbles may burst when the cap is removed from the vessel, thereby disseminating specimen into the environment. It is also possible that specimen residue from one vessel, which may have transferred to the gloved hand of a user, will come into contact with specimen from another vessel through routine or careless removal of the caps. Another risk is the potential for creating a contaminating aerosol when the cap and the vessel are physically separated from one another, possibly leading to false positives or exaggerated results in other specimens being simultaneously or subsequently assayed in the same general work area through cross-contamination.

Concerns with cross-contamination are especially acute when the assay being performed involves nucleic acid detection and an amplification procedure, such as the well known polymerase chain reaction (PCR) or a transcription based amplification system (TAS), such as transcription-mediated amplification (TMA) or strand displacement amplification (SDA). Since amplification is intended to enhance assay sensitivity by increasing the quantity of targeted nucleic acid sequences present in a specimen, transferring even a minute amount of specimen from another container, or target nucleic acid from a positive control sample, to an otherwise negative specimen could result in a false-positive result.

A pierceable cap can relieve the labor of removing screw caps prior to testing, which in the case of a high throughput instruments, maybe considerable. A pierceable cap can minimize the potential for creating contaminating specimen aerosols and may limit direct contact between specimens and humans or the environment. Certain caps with only a frangible layer, such as foil, covering the vessel opening may cause contamination by jetting droplets of the contents of the vessel into the surrounding environment when pierced. When a sealed vessel is penetrated by a transfer device, the volume of space occupied by a fluid transfer device will displace an equivalent volume of air from within the collection device. In addition, temperature changes can lead to a sealed collection vessel with a pressure greater than the surrounding air, which is released when the cap is punctured. Such air displacements may release portions of the sample into the surrounding air via an aerosol or bubbles. It would be desirable to have a cap that permits air to be transferred out of the vessel in a manner that reduces or eliminates the creation of potentially harmful or contaminating aerosols or bubbles.

Other existing systems have used absorptive penetrable materials above a frangible layer to contain any possible contamination, but the means for applying and retaining this material adds cost. In other systems, caps may use precut elastomers for a pierceable seal, but these caps may tend to leak. Other designs with valve type seals have been attempted, but the valve type seals may cause problems with dispense accuracy.

Ideally, a cap maybe used in both manual and automated applications, and would be suited for use with pipette tips made of a plastic material.

Generally, needs exist for improved apparatus and methods for sealing vessels with caps during transport, insertion of a transfer device, or transfer of samples.

SUMMARY OF THE INVENTION

Embodiments of the present invention solve some of the problems and/or overcome many of the drawbacks and disadvantages of the prior art by providing an apparatus and method for sealing vessels with pierceable caps.

Certain embodiments of the invention accomplish this by providing a pierceable cap apparatus including a shell, an access port in the shell for allowing passage of at least part of a transfer device through the access port, wherein the transfer device transfers a sample specimen, a lower frangible layer disposed across the access port for preventing transfer of the sample specimen through the access port prior to insertion of the at least part of the transfer device, one or more upper frangible layers disposed across the access port for preventing transfer of the sample specimen through the access port after insertion of the at least part of the transfer device through the lower frangible layer, one or more extensions between the lower frangible layer and the one or more upper frangible layers, and wherein the one or more extensions move and pierce the lower frangible layer upon application of pressure from the transfer device.

In embodiments of the present invention the lower frangible layer may be coupled to the one or more extensions. The one or more upper frangible layers may contact a conical tip of a transfer device during a breach of the lower frangible layer.

Embodiments of the present invention may include one or more upper frangible layers that are peripherally or otherwise vented.

In embodiments of the present invention the upper frangible layer and the lower frangible layer may be foil or other materials. The upper frangible layer and the lower frangible layer may be constructed of the same material and have the same dimensions. Either or both of the upper frangible layer and the lower frangible layer maybe pre-scored.

Embodiments of the present invention may include an exterior recess within the access port and between a top of the shell and the one or more extensions.

The one or more upper frangible layers maybe offset from the top of the shell or maybe flush with a top of the shell.

A peripheral groove for securing the lower frangible layer within the shell may be provided. A gasket for securing the lower frangible layer within the shell and creating a seal between the pierceable cap and a vessel maybe provided.

In embodiments of the present invention the movement of the one or more extensions may create airways for allowing air to move through the access port. The one or more upper frangible layers maybe peripherally vented creating a labyrinth-like path for the air moving through the access port.

Alternative embodiments of the present invention may include a shell, an access port through the shell, a lower frangible layer disposed across the access port, an upper frangible layer disposed across the access port, and one or more extensions between the lower frangible layer and the upper frangible layer wherein the one or more extensions are coupled to walls of the access port by one or more coupling regions.

Embodiments of the present invention may also include a method of piercing a cap including providing a pierceable cap comprising a shell, an access port through the shell, a lower frangible layer disposed across the access port, an upper frangible layer disposed across the access port, and one or more extensions between the lower frangible layer and the upper frangible layer wherein the one or more extensions are coupled to walls of the access port by one or more coupling regions, inserting a transfer device into the access port, applying pressure to the one or more upper frangible layers to breach the one or more upper frangible layers, applying pressure to the one or more extensions with the transfer device wherein the one or more extensions rotate around the one or more coupling regions to contact and breach the lower frangible layer, and further inserting the transfer device through the access port.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE INVENTION

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION

Figure 1B:
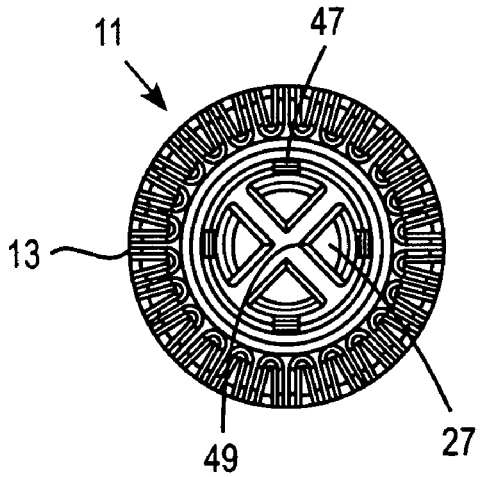
FIG. 1B is a top view of the pierceable cap of FIG. 1A.
Figure 1A:
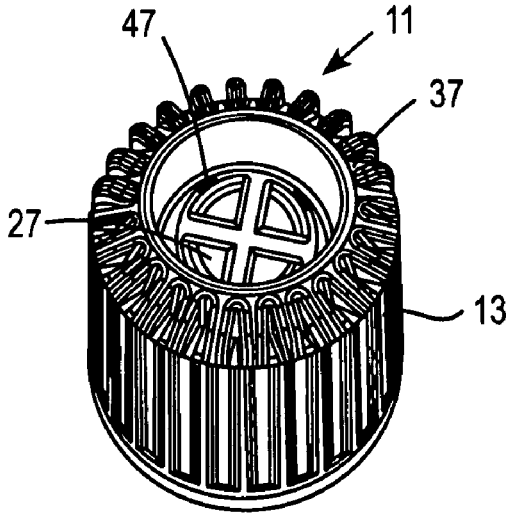
FIG. 1A is a perspective view of a pierceable cap with a diaphragm frangible layer.
Figure 1C:
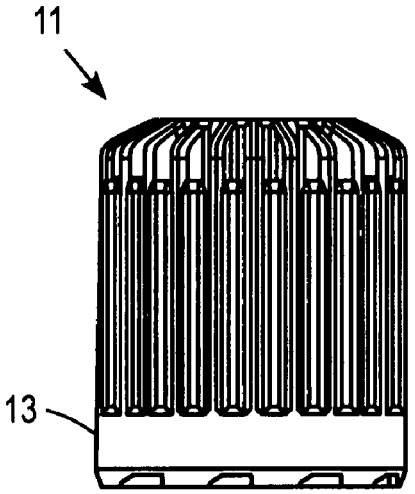
FIG. 1C is a side view of the pierceable cap of FIG. 1A.
Figure 1D:
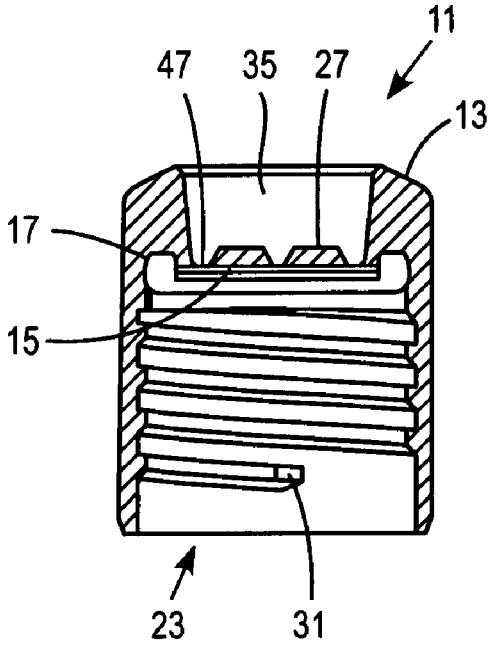
FIG. 1D is a cross sectional view of the pierceable cap of FIG. 1A.
Figure 1E:
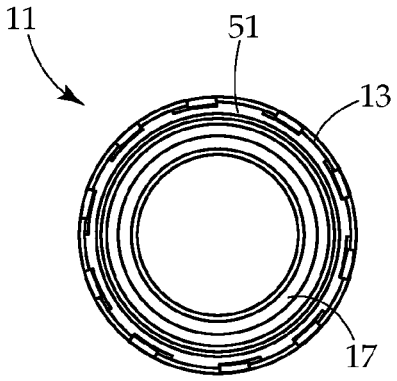
FIG. 1E is a bottom view as molded of the pierceable cap of FIG. 1A.
Figure 1F:
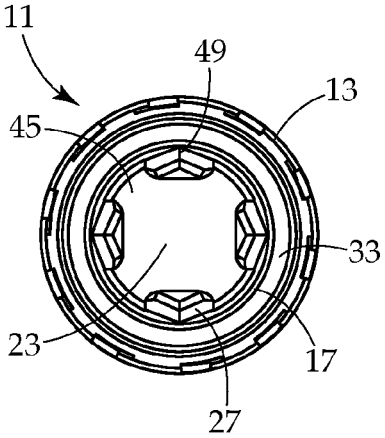
FIG. 1F is a bottom view of the pierceable cap of FIG. 1A pierced with the diaphragm not shown.
Figure 1G:
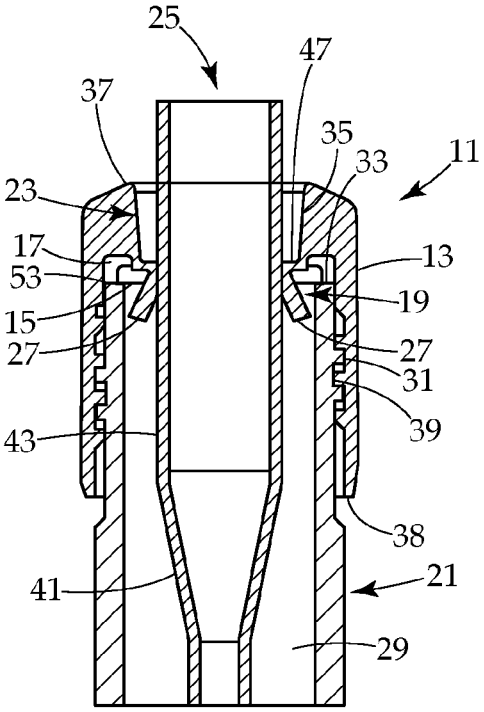
FIG. 1G is a cross sectional view of the pierceable cap of FIG. 1A coupled to a vessel with a pipette tip inserted through the cap.

Some embodiments of the invention are discussed in detail below. While specific example embodiments maybe discussed, it should be understood that this is done for illustration purposes only. A person skilled in the relevant art will recognize that other components and configurations maybe used without parting from the spirit and scope of the invention.

Embodiments of the present invention may include a pierceable cap for closing a vessel containing a sample specimen. The sample specimen may include diluents for transport and testing of the sample specimen. A transfer device, such as, but not limited to, a pipette, maybe used to transfer a precise amount of sample from the vessel to testing equipment. A pipette tip maybe used to pierce the pierceable cap. A pipette tip is preferably plastic, but maybe made of any other suitable material. Scoring the top of the vessel can permit easier piercing. The sample specimen maybe a liquid patient sample or any other suitable specimen in need of analysis.

A pierceable cap of the present invention may be combined with a vessel to receive and store sample specimens for subsequent analysis, including analysis with nucleic acid-based assays or immunoassays diagnostic for a particular pathogenic organism. When the sample specimen is a biological fluid, the sample specimen maybe, for example, blood, urine, saliva, sputum, mucous or other bodily secretion, pus, amniotic fluid, cerebrospinal fluid or seminal fluid. However, the present invention also contemplates materials other than these specific biological fluids, including, but not limited to, water, chemicals and assay reagents, as well as solid substances which can be dissolved in whole or in part in a fluid milieu (e.g., tissue specimens, tissue culture cells, stool, environmental samples, food products, powders, particles and granules). Vessels used with the pierceable cap of the present invention are preferably capable of forming a substantially leak-proof seal with the pierceable cap and can be of any shape or composition, provided the vessel is shaped to receive and retain the material of interest (e.g., fluid specimen or assay reagents). Where the vessel contains a specimen to be assayed, it is important that the composition of the vessel be essentially inert so that it does not significantly interfere with the performance or results of an assay.

Embodiments of the present invention may lend themselves to sterile treatment of cell types contained in the vessel. In this manner, large numbers of cell cultures maybe screened and maintained automatically. In situations where a cell culture is intended, a leak-proof seal is preferably of the type that permits gases to be exchanged across the membrane or seal. In other situations, where the vessels are pre-filled with transport media, stability of the media maybe essential. The membrane or seal, therefore, may have very low permeability.

FIGS. 1A-1G show an embodiment of a pierceable cap 11. The pierceable cap 11 may include a shell 13, a frangible layer 15, and, optionally, a gasket 17.

The shell 13 maybe generally cylindrical in shape or any other shape suitable for covering an opening 19 of a vessel 21. The shell 13 is preferably made of plastic resin, but maybe made of any suitable material. The shell 13 maybe molded by injection molding or other similar procedures. Based on the guidance provided herein, those skilled in the will be able to select a resin or mixture of resins having hardness and penetration characteristics which are suitable for a particular application, without having to engage in anything more than routine experimentation. Additionally, skilled artisans will realize that the range of acceptable cap resins will also depend on the nature of the resin or other material used to form the vessel 21, since the properties of the resins used to form these two components will affect how well the cap 11 and vessel 21 can form a leak proof seal and the ease with which the cap can be securely screwed onto the vessel. To modify the rigidity and penetrability of a cap, those skilled in the art will appreciate that the molded material maybe treated, for example, by heating, irradiating or quenching. The shell 13 may have ridges or grooves to facilitate coupling of the cap 11 to a vessel 21.

The cap 11 maybe injection molded as a unitary piece using procedures well-known to those skilled in the art of injection molding, including a multi-gate process for facilitating uniform resin flow into the cap cavity used to form the shape of the cap.

The vessel 21 maybe a test tube, but maybe any other suitable container for holding a sample specimen.

The frangible layer 15 maybe a layer of material located within an access port 23. For the purposes of the present invention, "frangible" means pierceable or tearable. Preferably, the access port 23 is an opening through the shell 13 from a top end 37 of the shell 13 to an opposite, bottom end 38 of the shell 13. If the shell 13 is roughly cylindrical, then the access port 23 may pass through the end of the roughly cylindrical shell 13. The access port 23 may also be roughly cylindrical and maybe concentric with a roughly cylindrical shell 13.

Figure 2A:
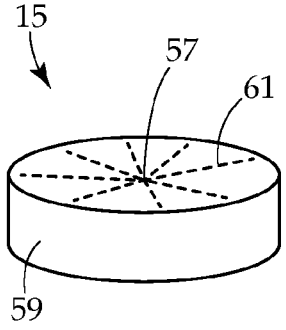
FIG. 2A is a perspective view of a possible frangible layer diaphragm.
Figure 2B:
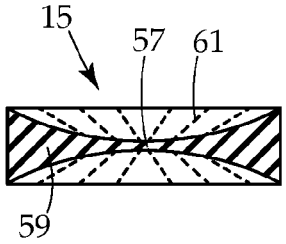
FIG. 2B is a cross sectional view of the frangible layer of FIG. 2A.
Figure 3B:
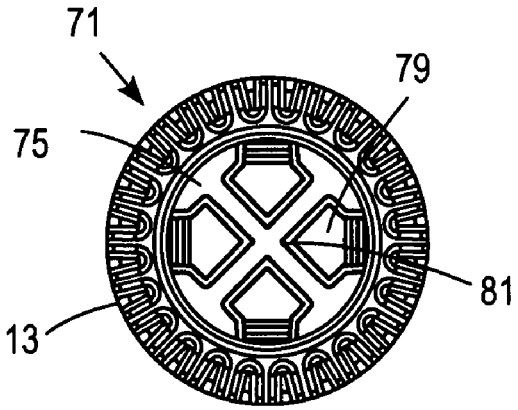
FIG. 3B is a top view of the pierceable cap of FIG. 3A.
Figure 3A:
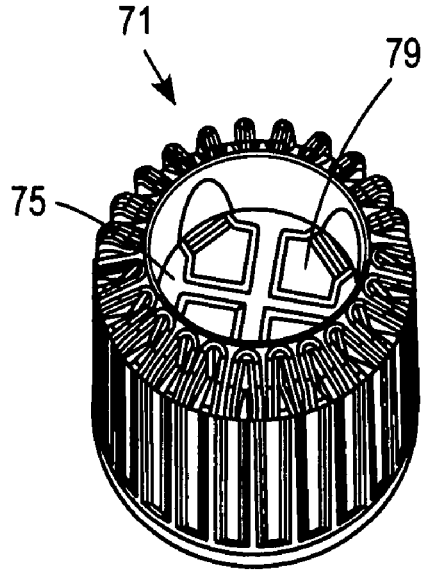
FIG. 3A is a perspective view of a pierceable cap with a foil frangible layer.
Figure 3C:
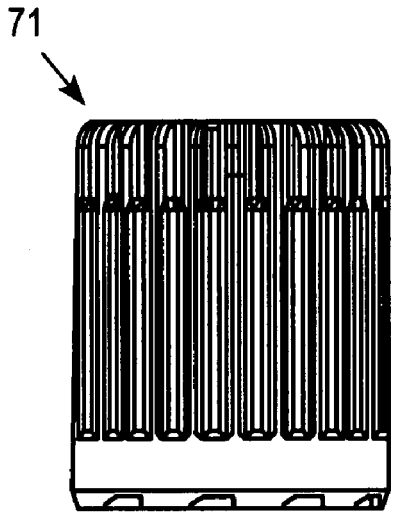
FIG. 3C is a side view of the pierceable cap of FIG. 3A.
Figure 3D:
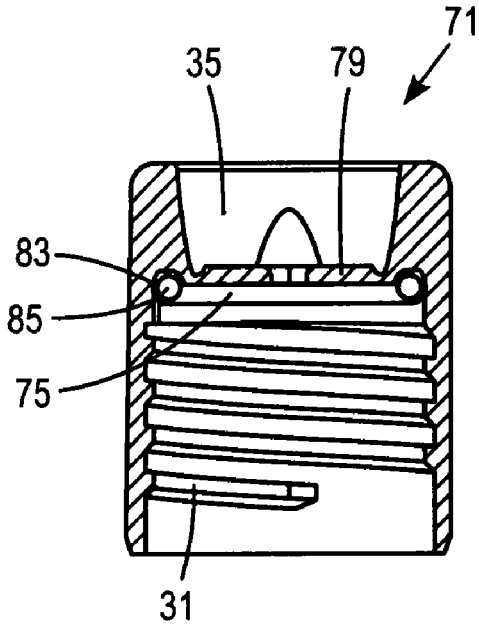
FIG. 3D is a cross sectional view of the pierceable cap of FIG. 3A.
Figure 3E:
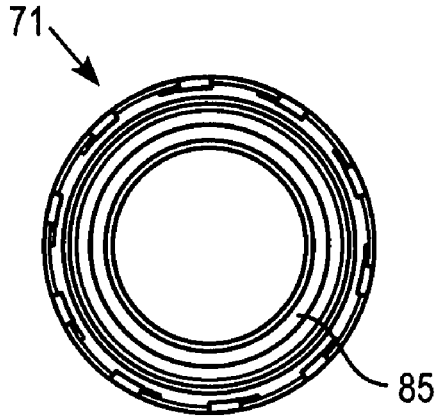
FIG. 3E is a bottom view as molded of the pierceable cap of FIG. 3A.
Figure 3F:
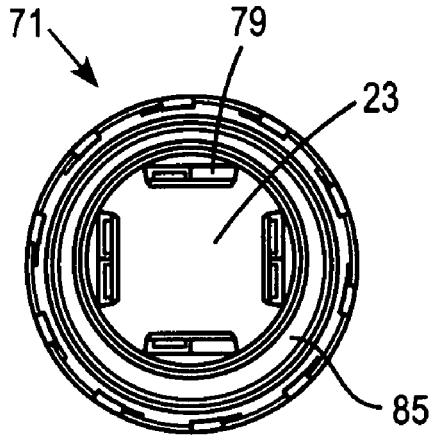
FIG. 3F is a bottom view of the pierceable cap of FIG. 3A pierced with foil not shown.
Figure 3G:
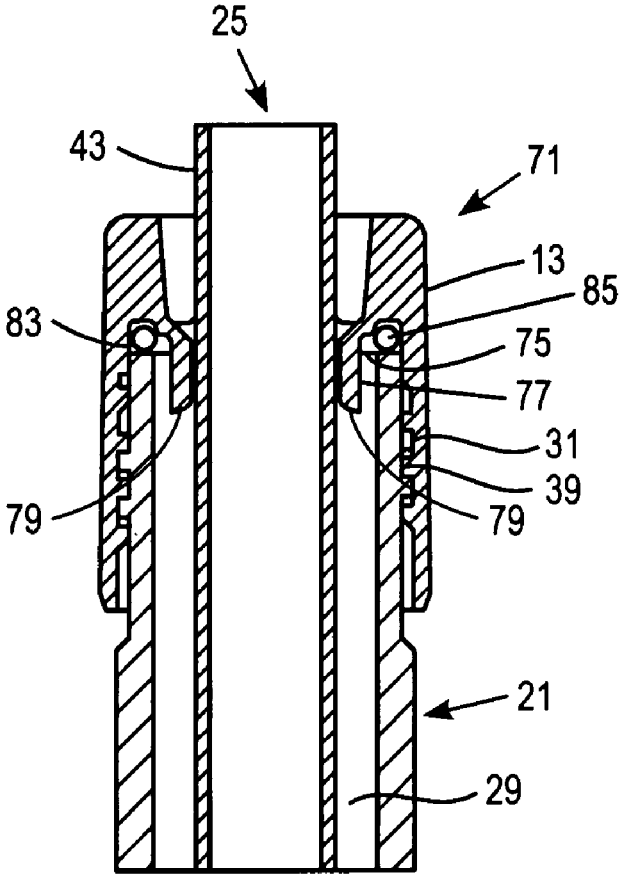
FIG. 3G is a cross sectional view of the pierceable cap of FIG. 3A coupled to a vessel with a pipette tip inserted through the cap.

The frangible layer 15 may be disposed within the access port 23 such that transfer of the sample specimen through the access port is reduced or eliminated. In FIGS. 1A-1G, the frangible layer 15 is a diaphragm. Preferably, the frangible layer 15 is a thin, multilayer membrane with a consistent cross section. Alternative frangible layers 15 are possible. For example, FIGS. 2A-2B, not shown to scale, are exemplary frangible layers 15 in the form of diaphragms. The frangible layer 15 is preferably made of rubber, but maybe made of plastic, foil, combinations thereof or any other suitable material. The frangible layer may also be a Mylar or metal coated Mylar fused, resting, or partially resting upon an elastic diaphragm. A diaphragm may also serve to close the access port 23 after a transfer of the sample specimen to retard evaporation of any sample specimen remaining in the vessel 21. The frangible layer 15 maybe thinner in a center 57 of the frangible layer 15 or in any position closest to where a break in the frangible layer 15 is desired. The frangible layer 15 maybe thicker at a rim 59 where the frangible layer 15 contacts the shell 13 and/or the optional gasket 17. Alternatively, the frangible layer 15 may be thicker at a rim 59 such that the rim 59 of the frangible layer 15 forms a functional gasket within the shell 13 without the need for the gasket 17. The frangible layer 15 is preferably symmetrical radially and top to bottom such that the frangible layer 15 maybe inserted into the cap 11 with either side facing a well 29 in the vessel 21. The frangible layer 15 may also serve to close the access port 23 after use of a transfer device 25. A peripheral groove 53 maybe molded into the shell 13 to secure the frangible layer 15 in the cap 11 and/or to retain the frangible layer 15 in the cap 11 when the frangible layer 15 is pierced. The peripheral groove 53 in the cap 11 may prevent the frangible layer 15 from being pushed down into the vessel 21 by a transfer device 25. One or more pre-formed scores or slits 61 maybe disposed in the frangible layer 15. The one or more preformed scores or slits 61 may facilitate breaching of the frangible layer 15. The one or more preformed scores or slits 61 maybe arranged radially or otherwise for facilitating a breach of the frangible layer 15.

The frangible layer 15 maybe breached during insertion of a transfer device 25. Breaching of the frangible layer 15 may include piercing, tearing open or otherwise destroying the structural integrity and seal of the frangible layer 15. The frangible layer 15 may be breached by a movement of one or more extensions 27 around or along a coupling region 47 toward the well 29 in the vessel 21. The frangible layer 15 maybe disposed between the one or more extensions 27 and the vessel 21 when the one or more extensions 27 are in an initial position.

In certain embodiments, the frangible layer 15 and the one or more extensions 27 maybe of a unitary construction. In some embodiments, the one or more extensions 27 may be positioned in a manner to direct or realign a transfer device 25 so that the transfer device 25 may enter the vessel 21 in a precise orientation. In this manner, the transfer device 25 maybe directed to the center of the well 29, down the inner side of the vessel 21 or in any other desired orientation.

In embodiments of the present invention, the one or more extensions 27 maybe generated by pre-scoring a pattern, for example, a "+", in the pierceable cap 11 material. In alternative embodiments, the one or more extensions 27 maybe separated by gaps. Gaps maybe of various shapes, sizes and configuration depending on the desired application. In certain embodiments, the pierceable cap 11 may be coated with a metal, such as gold, through a vacuum metal discharge apparatus or by paint. In this manner, a pierced cap maybe easily visualized and differentiated from a non-pierced cap by the distortion in the coating.

The one or more extensions 27 maybe integrally molded with the shell 13. The one or more extensions 27 may have different configurations depending on the use. The one or more extensions 27 maybe connected to the shell 13 by the one or more coupling regions 47. The one or more extensions 27 may be include points 49 facing into the center of the cap 11 or towards a desired breach point of the frangible layer 15. The one or more extensions 27 maybe paired such that each leaf faces an opposing leaf. Preferred embodiments of the present invention may include four or six extensions arranged in opposing pairs. FIGS. 1A-1G show four extensions. The one or more coupling regions 47 are preferably living hinges, but may be any suitable hinge or attachment allowing the one or more extensions to move and puncture the frangible layer 15.

The access port 23 maybe at least partially obstructed by the one or more extensions 27. The one or more extensions 27 maybe thin and relatively flat. Alternatively, the one or more extensions 27 maybe leaf-shaped. Other sizes, shapes and configurations are possible. The access port 23 maybe aligned with the opening 19 of the vessel 21.

The gasket 17 maybe an elastomeric ring between the frangible layer 15 and the opening 19 of the vessel 21 or the frangible layer 15 and the cap 11 for preventing leakage before the frangible layer 15 is broken. In some embodiments of the invention, the gasket 17 and the frangible layer 15 maybe integrated as a single part.

A surface 33 may hold the frangible layer 15 against the gasket 17 and the vessel 21 when the cap 11 is coupled to the vessel 21. An exterior recess 35 at a top 37 of the cap 11 maybe disposed to keep wet surfaces out of reach of a user's fingers during handling. Surfaces of the access portal 23 may become wet with portions of the sample specimen during transfer. The exterior recess 35 may reduce or eliminate contamination by preventing contact by the user or automated capping/de-capping instruments with the sample specimen during a transfer. The exterior recess 35 may offset the frangible layer 15 away from the top end 37 of the cap 11 towards the bottom end 38 of the cap 11.

The shell 13 may include screw threads 31 or other coupling mechanisms for joining the cap 11 to the vessel 15. Coupling mechanisms preferably frictionally hold the cap 11 over the opening 19 of the vessel 21 without leaking. The shell 13 may hold the gasket 17 and the frangible layer 15 against the vessel 21 for sealing in the sample specimen without leaking. The vessel 21 preferably has complementary threads 39 for securing and screwing the cap 11 on onto the vessel. Other coupling mechanisms may include complementary grooves and/or ridges, a snap-type arrangement, or others.

The cap 11 may initially be separate from the vessel 21 or maybe shipped as coupled pairs. If the cap 11 and the vessel 21 are shipped separately, then a sample specimen maybe added to the vessel 21 and the cap 11 maybe screwed onto the complementary threads 39 on the vessel 21 before transport. If the cap 11 and the vessel 21 are shipped together, the cap 11 maybe removed from the vessel 11 before adding a sample specimen to the vessel 21. The cap 11 may then be screwed onto the complementary threads 39 on the vessel 21 before transport. At a testing site, the vessel 21 may be placed in an automated transfer instrument without removing the cap 11. Transfer devices 25 are preferably pipettes, but maybe any other device for transferring a sample specimen to and from the vessel 21. When a transfer device tip 41 enters the access port 23, the transfer device tip 41 may push the one or more extensions 27 downward towards the well 29 of the vessel 21. The movement of the one or more extensions 27 and related points 49 may break the frangible layer 15. As a full shaft 43 of the transfer device 25 enters the vessel 21 through the access port 23, the one or more extensions 27 maybe pushed outward to form airways or vents 45 between the frangible layer 15 and the shaft 43 of the transfer device 25. The airways or vents 45 may allow air displaced by the tip 41 of the transfer device to exit the vessel 21. The airways or vents 45 may prevent contamination and maintain pipetting accuracy. Airways or vents 45 may or may not be used for any embodiments of the present invention.

The action and thickness of the one or more extensions 27 may create airways or vents 45 large enough for air to exit the well 29 of the vessel 21 at a low velocity The low velocity exiting air preferably does not expel aerosols or small drops of liquid from the vessel. The low velocity exiting air may reduce contamination of other vessels or surfaces on the pipetting instrument. In some instances, drops of the sample specimen may cling to an underside surface 51 of the cap 11. In existing systems, if the drops completely filled and blocked airways on a cap, the sample specimen could potentially form bubbles and burst or otherwise create aerosols and droplets that would be expelled from the vessel and cause contamination. In contrast, the airways and vents 45 created by the one or more extensions 27, maybe large enough such that a sufficient quantity of liquid cannot accumulate and block the airways or vents 45. The large airways or vents 45 may prevent the pressurization of the vessel 21 and the creation and expulsion of aerosols or droplets. The airways or vents 45 may allow for more accurate transfer of the sample specimens.

An embodiment may include a molded plastic shell 13 to reduce costs. The shell 13 maybe made of polypropylene for sample compatibility and for providing a resilient living hinge 47 for the one or more extensions 27. The cap 11 may preferably include three to six dart-shaped extensions 27 hinged at a perimeter of the access portal 23. For moldability, the portal may have a planar shut-off, 0.030" gaps between extensions 27, and a 10 degree draft. The access portal 23 maybe roughly twice the diameter of the tip 41 of the transfer device 25. The diameter of the access portal 23 may be wide enough for adequate venting yet small enough that the one or more extensions 27 have space to descend into the vessel 21. The exterior recess 25 in the top of the shell 13 maybe roughly half the diameter of the access portal 23 deep, which prevents any user's finger tips from touching the access portal.

FIGS. 3A-3G show an alternative embodiment of a cap 71 with a foil laminate used as a frangible layer 75. The frangible layer 75 maybe heat welded or otherwise coupled to an underside 77 of one or more portal extensions 79. During insertion of a transfer device 25, the frangible layer 75 maybe substantially ripped as the one or more portal extensions 79 are pushed towards the well 29 in the vessel or as tips 81 of the one or more portal extensions 79 are spread apart. The foil laminate of the frangible layer 75 maybe inserted or formed into a peripheral groove 83 in the cap 71. An o-ring 85 may also be seated within the peripheral groove 83 for use as a sealing gasket. The peripheral groove 83 may retain the o-ring 85 over the opening 29 of the vessel 21 when the cap 71 is coupled to the vessel 21. The cap 71 operates similarly to the above caps.

Figure 4A:
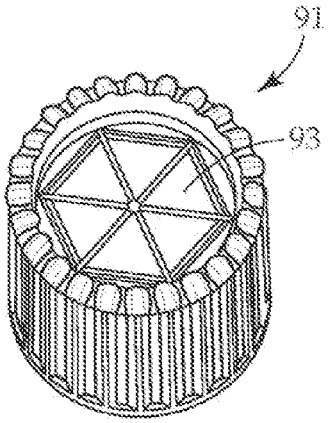
FIG. 4A is a perspective view of a pierceable cap with a liner frangible layer and extensions in a flat star pattern.
Figure 4B:
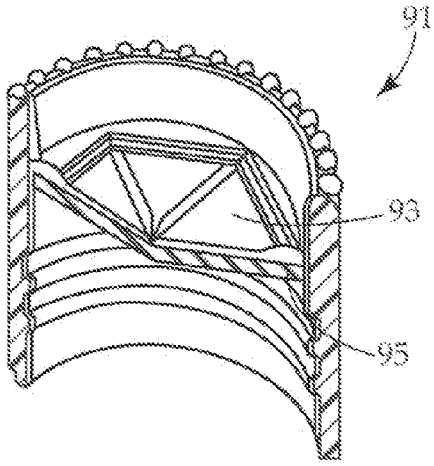
FIG. 4B is a perspective cut away view of the pierceable cap of FIG. 4A.

FIGS. 4A-4B show an alternative cap 91 with an elastomeric sheet material as a frangible layer 95. The frangible layer 95 maybe made of easy-tear silicone, such as a silicone sponge rubber with low tear strength, hydrophobic Teflon, or other similar materials. The frangible layer 95 may be secured adjacent to or adhered to the cap 91 for preventing unwanted movement of the frangible layer 95 during transfer of the sample specimen. The elastomeric material may function as a vessel gasket and as the frangible layer 95 in the area of a breach. One or more extensions 93 may breach the frangible layer 95. The cap 91 operates similarly to the above caps.

Figure 5A:
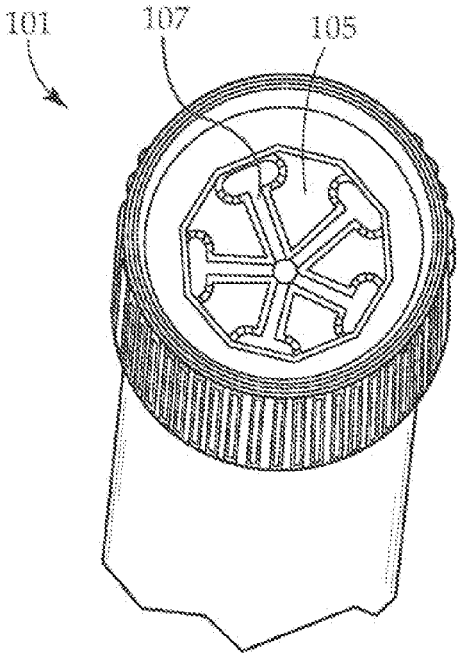
FIG. 5A is a perspective view of a pierceable cap with a conical molded frangible layer and extensions in a flat star pattern.
Figure 5B:
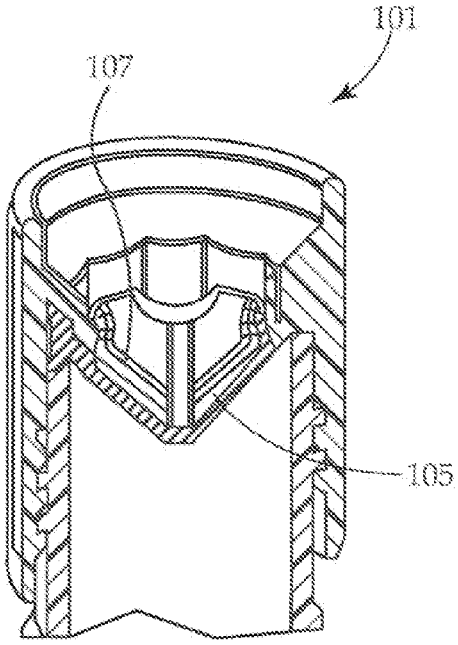
FIG. 5B is a perspective cut away view of the pierceable cap of FIG. 5A.
Figure 6A:
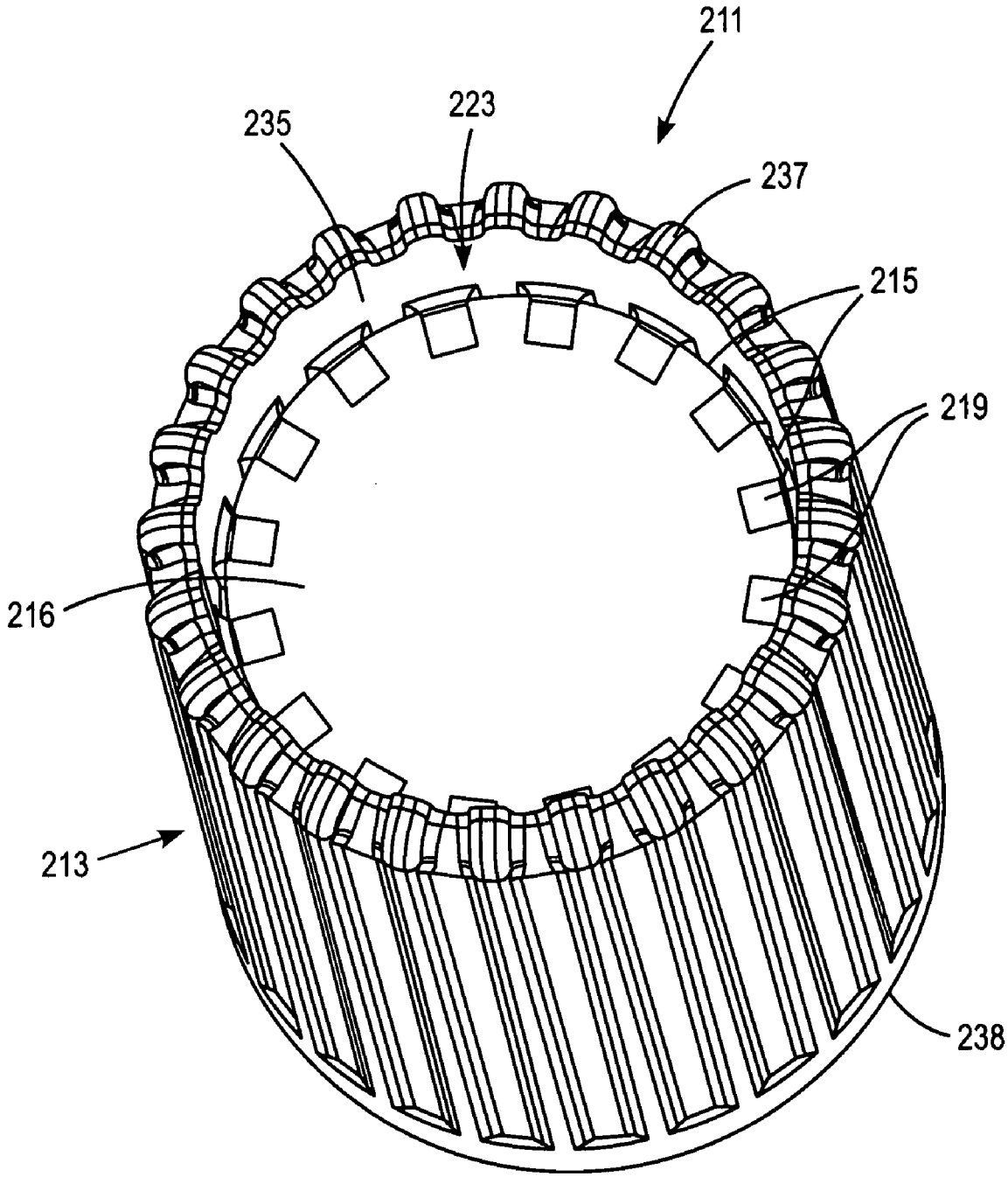
FIG. 6A is a perspective top view of a pierceable cap with two frangible layers with a moderately recessed upper frangible layer.
Figure 6B:
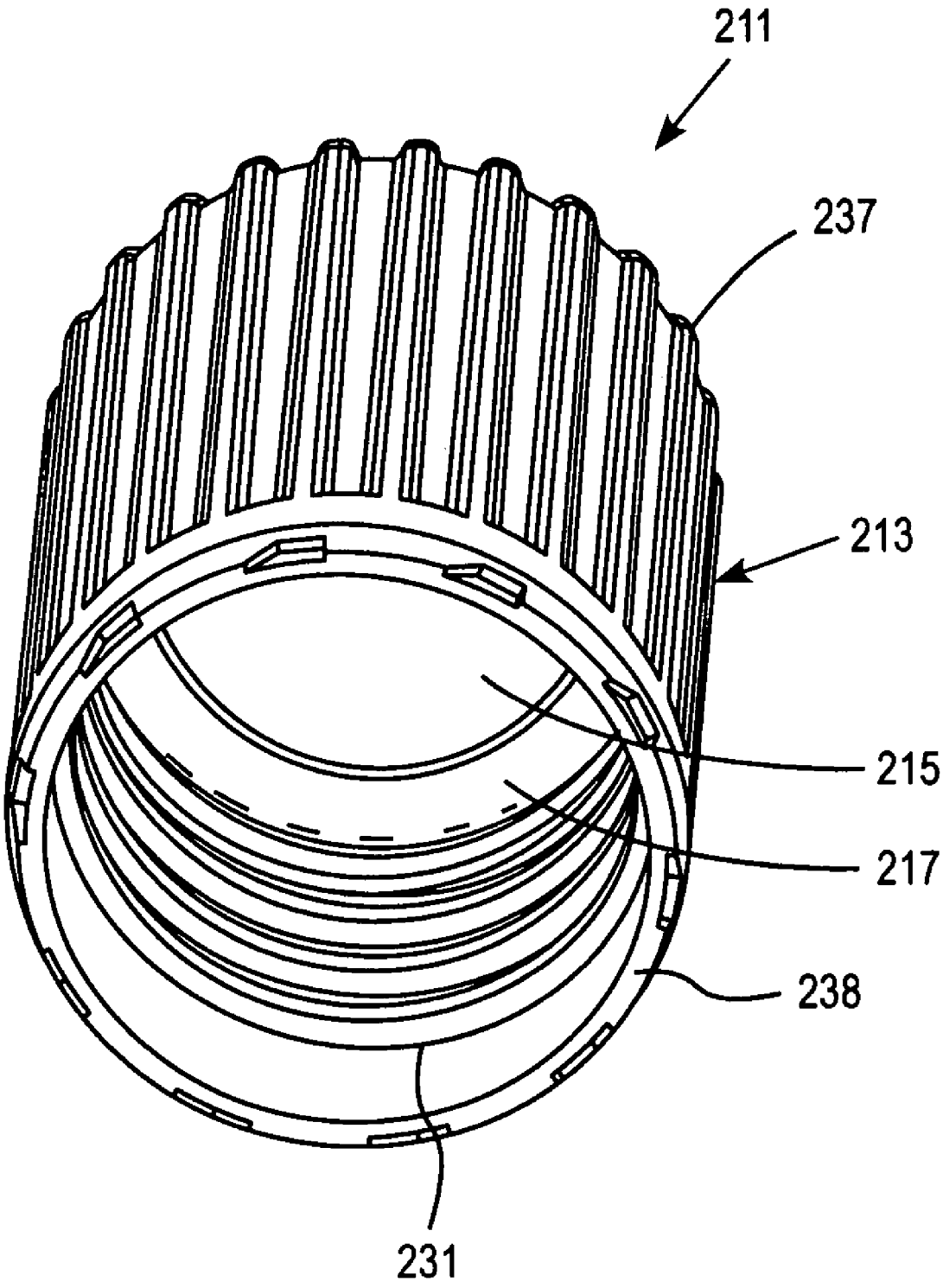
FIG. 6B is a perspective bottom view of the pierceable cap of FIG. 6A.
Figure 6C:
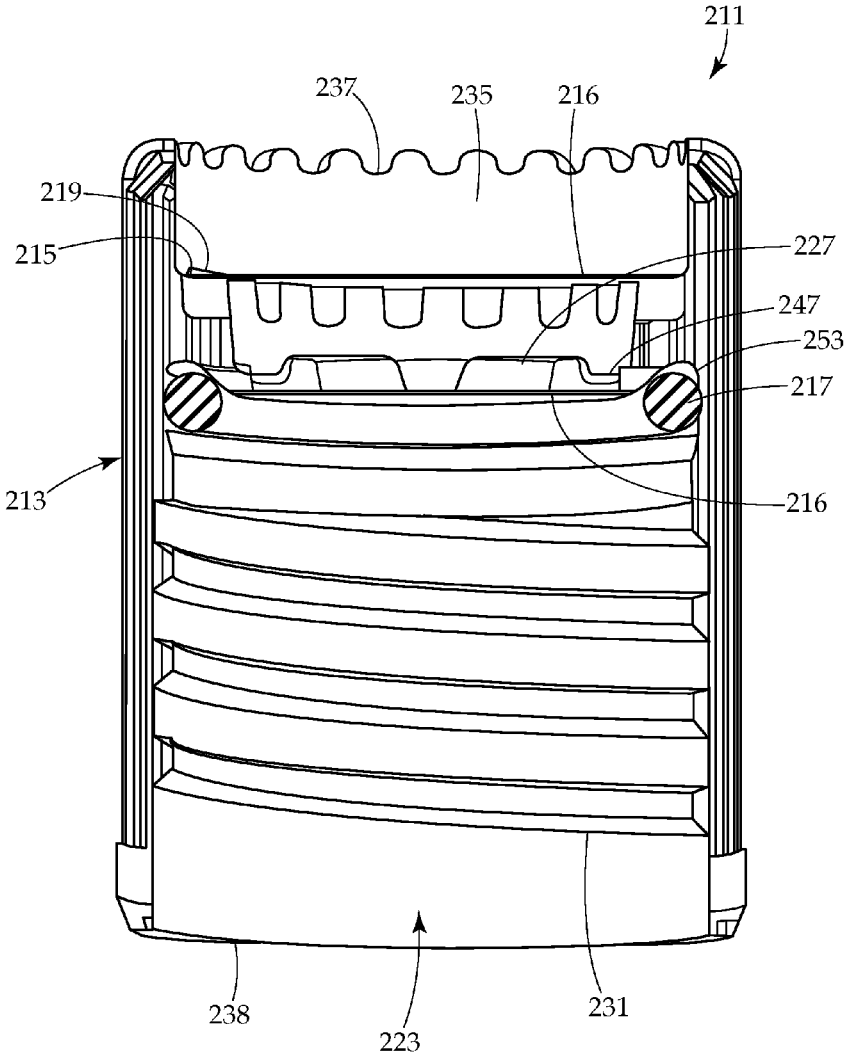
FIG. 6C is a cross sectional view of the pierceable cap of FIG. 6A.
Figure 6D:
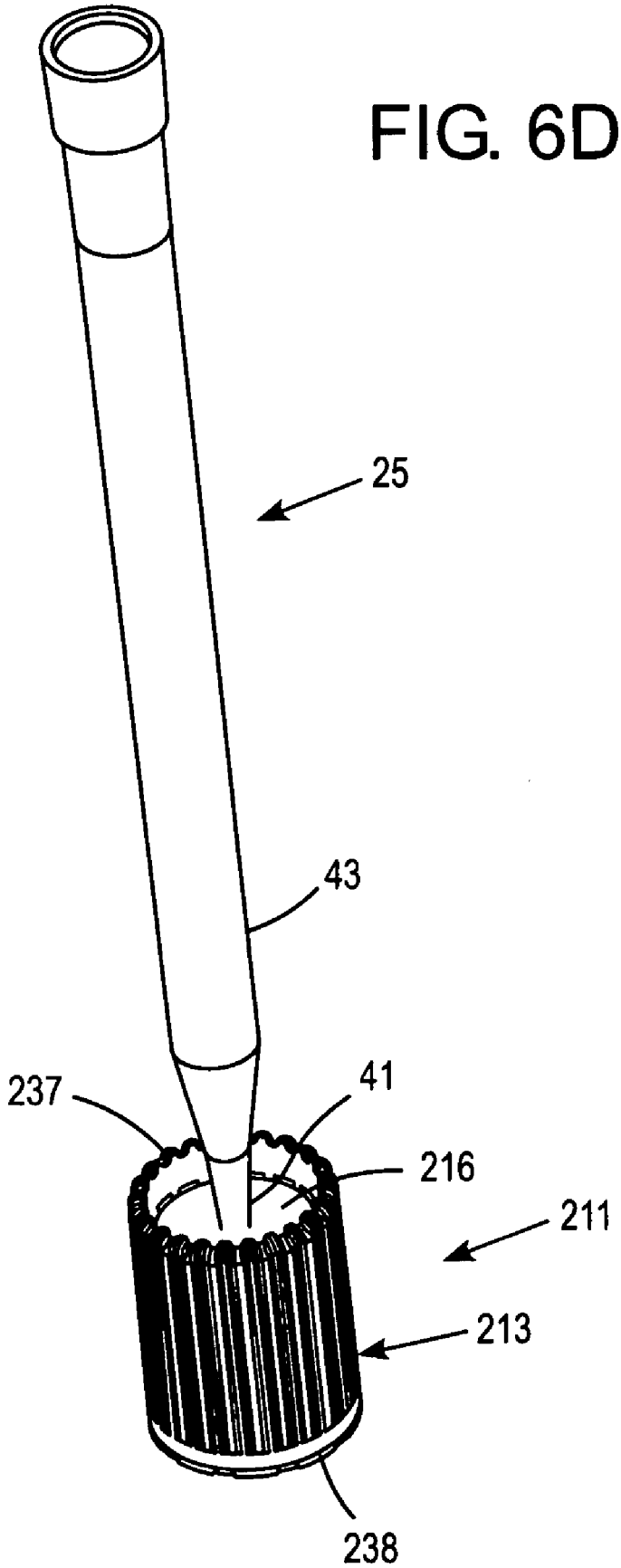
FIG. 6D is a perspective view of the pierceable cap of FIG. 6A with a pipette tip inserted through the two frangible layers.
Figure 6E:
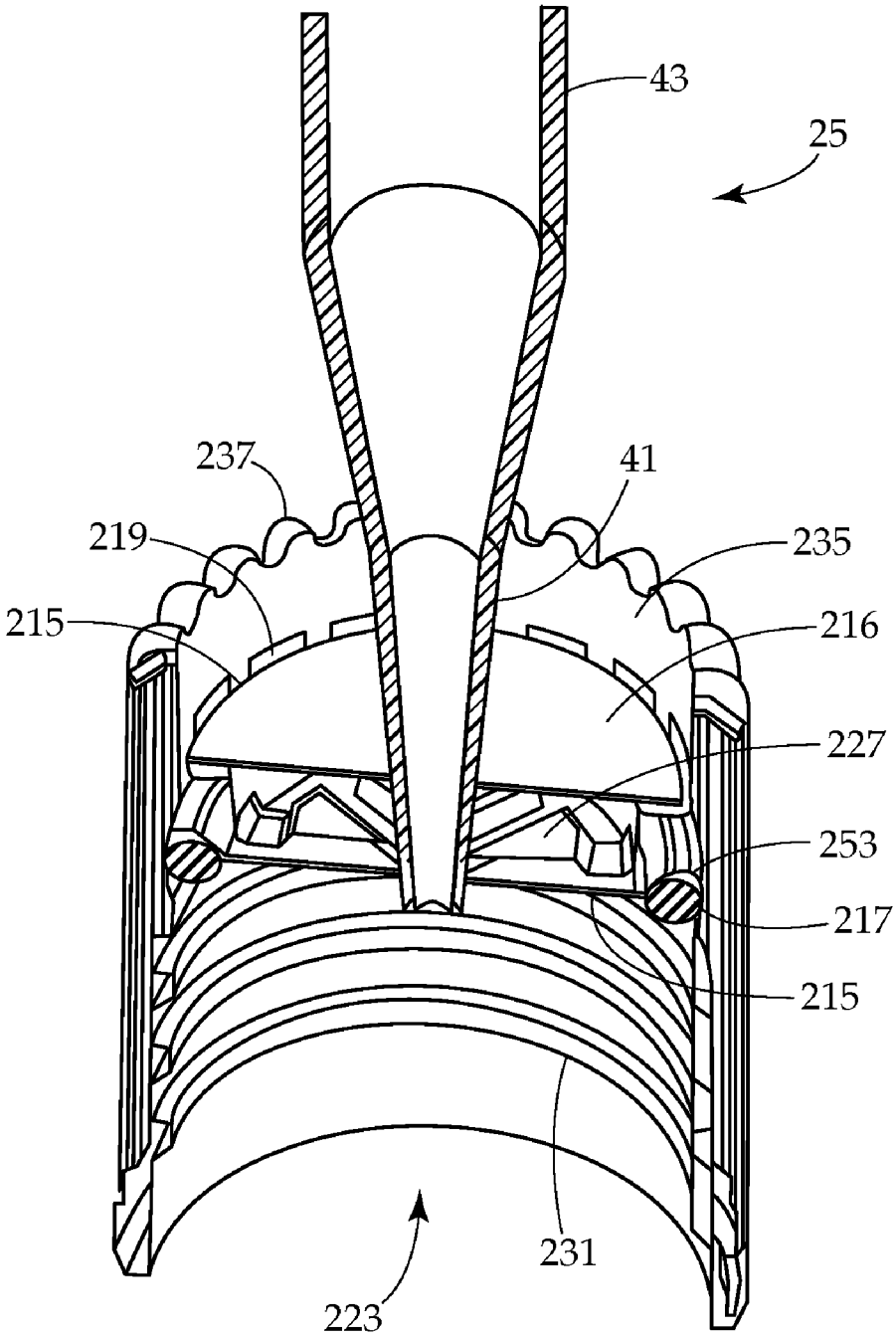
FIG. 6E is a cross sectional view of the pierceable cap of FIG. 6A with a pipette tip inserted through the two frangible layers.

FIGS. 5A-5B show an alternative cap 101 with a conical molded frangible layer 105 covered by multiple extensions 107. The cap 101 operates similarly to the above caps.

FIG. 6A-6E show an alternative cap 211 with multiple frangible layers 215, 216. The pierceable cap 211 may include a shell 213, a lower frangible layer 215, one or more upper frangible layers 216, and, optionally, a gasket 217. Where not specified, the operation and components of the alternative cap 211 are similar to those described above.

The shell 213 maybe generally cylindrical in shape or any other shape suitable for covering an opening 19 of a vessel 21 as described above. The shell 213 of the alternative cap 211 may include provisions for securing two or more frangible layers. The following exemplary embodiment describes a pierceable cap 211 with a lower frangible layer 215 and an upper frangible layer 216, however, it is anticipated that more frangible layers may be used disposed in series above the lower frangible layer 215.

The frangible layers 215, 216 maybe located within an access port 223. The lower frangible layer 215 is generally disposed as described above. Preferably, the access port 223 is an opening through the shell 213 from a top end 237 of the shell 213 to an opposite, bottom end 238 of the shell 213. If the shell 213 is roughly cylindrical, then the access port 223 may pass through the ends of the roughly cylindrical shell 213. The access port 223 may also be roughly cylindrical and maybe concentric with a roughly cylindrical shell 213.

The frangible layers 215, 216 maybe disposed within the access port 223 such that transfer of the sample specimen through the access port is reduced or eliminated. In FIGS. 6A-6E, the frangible layers 215, 216 maybe foil. The foil maybe any type of foil, but in preferred embodiments maybe 100 micron, 38 micron, 20 micron, or any other size foil. More preferably, the foil for the upper frangible layer 216 is 38 micron or 20 micron size foil to prevent bending of tips 41 of the transfer devices 25. Exemplary types of foil that maybe used in the present invention include "Easy Pierce Heat Sealing Foil" from ABGENE or "Thermo-Seal Heat Sealing Foil" from ABGENE. Other types of foils and frangible materials maybe used. In preferred embodiments of the present invention, the foil maybe a composite of several types of materials. The same or different selected materials maybe used in the upper frangible layer 216 and the lower frangible layer 215. Furthermore, the upper frangible layer 216 and the lower frangible layer 225 may have the same or different diameters. The frangible layers 215, 216 maybe bonded to the cap by a thermal process such as induction heating or heat sealing.

A peripheral groove 253 maybe molded into the shell 213 to secure the lower frangible layer 215 in the pierceable cap 211 and/or to retain the lower frangible layer 215 in the cap 211 when the lower frangible layer 215 is pierced. The peripheral groove 253 in the cap 211 may prevent the lower frangible layer 215 from being pushed down into the vessel 21 by a transfer device 25. One or more pre-formed scores or slits maybe disposed in the lower frangible layer 215 or the upper frangible layer 216.

The one or more upper frangible layers 216 maybe disposed within the shell 213 such that one or more extensions 227 are located between the lower frangible layer 215 and the upper frangible layer 216. Preferably, the distance between the lower frangible layer 215 and the upper frangible layer 216 is as large as possible. The distance may vary depending on several factors including the size of the transfer device. In some embodiments, the distance between the lower frangible layer 215 and the upper frangible layer 216 is approximately 0.2 inches. More preferably, the distance between the lower frangible layer 215 and the upper frangible layer is approximately 0.085 inches. In a preferred embodiment of the present invention, the gap maybe 0.085 inches. The upper frangible layer 216 is preferably recessed within the access port 223 to prevent contamination by contact with a user's hand. Recessing the upper frangible layer 216 may further minimize manual transfer of contamination. The upper frangible layer 216 may block any jetted liquid upon puncture of the lower frangible layer 215.

The upper frangible layer 216 may sit flush with the walls of the access port 223 or maybe vented with one or more vents 215. The one or more vents 215 may be created by spacers 219. The one or more vents 215 may diffuse jetted air during puncture and create a labyrinth for trapping any jetted air during puncture.

The upper frangible layer 216 preferably contacts the conical tip 41 of a transfer device 25 during puncture of the lower frangible layer 215. The upper frangible layer 216 maybe breached before the breaching of the lower frangible layer 215. The frangible layers 215, 216 maybe breached during insertion of a transfer device 25 into the access port 223. Breaching of the frangible layers 215,216 may include piercing, tearing open or otherwise destroying the structural integrity and seal of the frangible layers 215, 216. The lower frangible layer 215 maybe breached by a movement of one or more extensions 227 around or along a coupling region 247 toward a well 29 in the vessel 21. The lower frangible layer 215 maybe disposed between the one or more extensions 227 and the vessel 21 when the one or more extensions 227 are in an initial position.

A gasket 217 maybe an elastomeric ring between the lower frangible layer 215 and the opening 19 of the vessel 21 for preventing leakage before the frangible layers 215, 216 are broken.

An exterior recess 235 at a top 237 of the pierceable cap 211 maybe disposed to keep wet surfaces out of reach of a user's fingers during handling. Surfaces of the access portal 223 may become wet with portions of the sample specimen during transfer. The exterior recess 235 may reduce or eliminate contamination by preventing contact by the user or automated capping/de-capping instruments with the sample specimen during a transfer. The exterior recess 235 may offset the frangible layers 215, 216 away from the top end 237 of the cap 211 towards the bottom end 238 of the cap 211.

The shell 213 may include screw threads 231 or other coupling mechanisms for joining the cap 211 to the vessel 15 as described above.

The cap 211 may initially be separate from the vessel 21 or maybe shipped as coupled pairs. If the cap 211 and the vessel 21 are shipped separately, then a sample specimen maybe added to the vessel 21 and the cap 211 maybe screwed onto the complementary threads on the vessel 21 before transport. If the cap 211 and the vessel 21 are shipped together, the cap 211 maybe removed from the vessel 21 before adding a sample specimen to the vessel 21. The cap 211 may then be screwed onto the complementary threads on the vessel 21 before transport. At a testing site, the vessel 21 may be placed in an automated transfer instrument without removing the cap 211.

Transfer devices 25 are preferably pipettes, but may be any other device for transferring a sample specimen to and from the vessel 21. When a transfer device tip 41 enters the access port 223, the transfer device tip 41 may breach the upper frangible layer. The tip 41 of the transfer device maybe generally conical while a shaft 43 maybe generally cylindrical. As the conical tip 41 of the transfer device continues to push through the breached upper frangible layer 216, the opening of the upper frangible layer 216 may expand with the increasing diameter of the conical tip 41.

The tip 41 of the transfer device 25 may then contact and push the one or more extensions 227 downward towards the well 29 of the vessel 21. The movement of the one or more extensions 227 and related points may break the lower frangible layer 215. At this time, the conical tip 41 of the transfer device may still be in contact with the upper frangible layer 216. As the increasing diameter of the conical tip 41 and the full shaft 43 of the transfer device 25 enters the vessel 21 through the access port 223, the one or more extensions 227 maybe pushed outward to form airways or vents between the lower frangible layer 215 and the shaft 43 of the transfer device 25. The created airways or vents may allow air displaced by the tip 41 of the transfer device 25 to exit the vessel 21. The airways or vents may prevent contamination and maintain pipetting accuracy. The upper frangible layer 216 prevents contamination by creating a seal with the transfer device tip 41 above the one or more extensions 227. Exiting air is vented 215 through a labyrinth-type path from the vessel to the external environment.

The upper frangible layer 216 in the pierceable cap 211 may have a different functionality than the lower frangible layer 215. The lower frangible layer 215, which maybe bonded to the one or more extensions 227, may tear in a manner such that a relatively large opening is opened in the lower frangible layer 215. The relatively large opening may create a relatively large vent in the lower frangible layer 215 to eliminate or reduce pressurization from the insertion of the tip 41 of a transfer device 25. In contrast to the lower frangible layer 215, the upper frangible layer 216 may act as a barrier to prevent any liquid that may escape from the pierceable cap 211 after puncture of the lower frangible layer 215. The upper frangible layer 216 maybe vented 215 at its perimeter to prevent pressurization of the intermediate volume between the upper frangible layer 216 and the lower frangible layer 215. The upper frangible layer 216 may also be vented 215 at its perimeter to diffuse any jetting liquid by creating multiple pathways for vented liquid and/or air to escape from the intermediate volume between the upper frangible layer 216 and the lower frangible layer 215.

The upper frangible layer 216 maybe active on puncture, and maybe located within the aperture of the pierceable cap 211 at a height such that the upper frangible layer 216 acts upon the conical tip 41 of the transfer device 25 when the lower frangible layer 215 is punctured. Acting on the conical tip 41 and not the cylindrical shaft 43 of the transfer device 25 may assure relatively close contact between the tip 41 and the upper frangible layer 216 and may maximize effectiveness of the upper frangible layer 216 as a barrier.

The selected material for the upper frangible layer 216 may tear open in a polygonal shape, typically hexagonal. When the conical tip 41 is fully engaged with the upper frangible layer 216 sufficient venting exists such that there is little or no impact on transfer volumes aspirated from or pipetted into the shaft 43 of the transfer device 25.

Alternatively to the pierceable cap 211 depicted in FIGS. 6A-6E, the upper frangible layer 216 maybe flush with a top 237 of the shell 213. Venting mayor may not be used when the upper frangible layer 216 is flush with the top 237 of the shell 213. Preferably, the distance between the lower frangible layer 215 and the upper frangible layer is approximately 0.2 inches. The foil used with the upper frangible layer 216 flush with the top 237 of the shell maybe a heavier or lighter foil or other material than that used with the lower frangible layer 215. Venting mayor may not be used with any embodiments of the present invention.

Figure 7A:
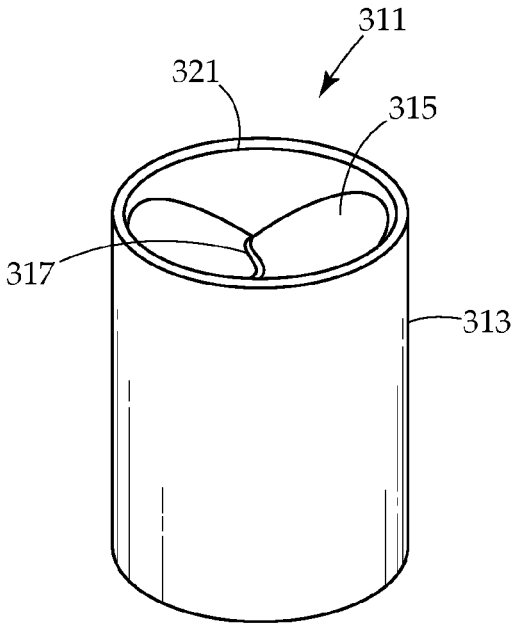
FIG. 7A is a perspective view of a pierceable cap with a V-shaped frangible layer.
Figure 7B:
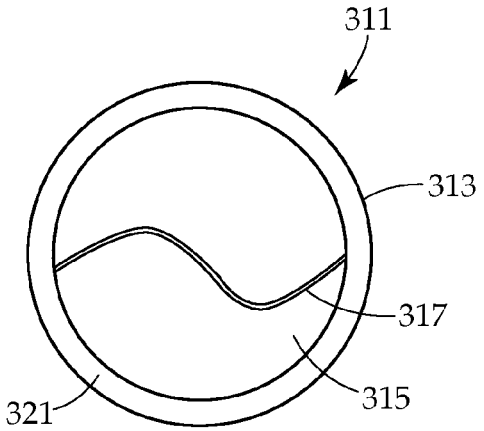
FIG. 7B is a top view of the pierceable cap of FIG. 7A.
Figure 7C:
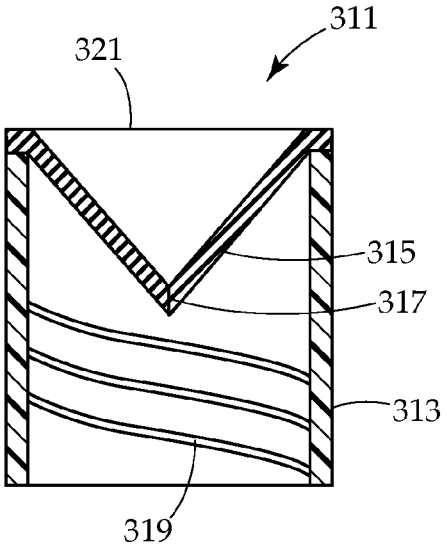
FIG. 7C is a cross sectional view of the pierceable cap of FIG. 7B.
Figure 8A:
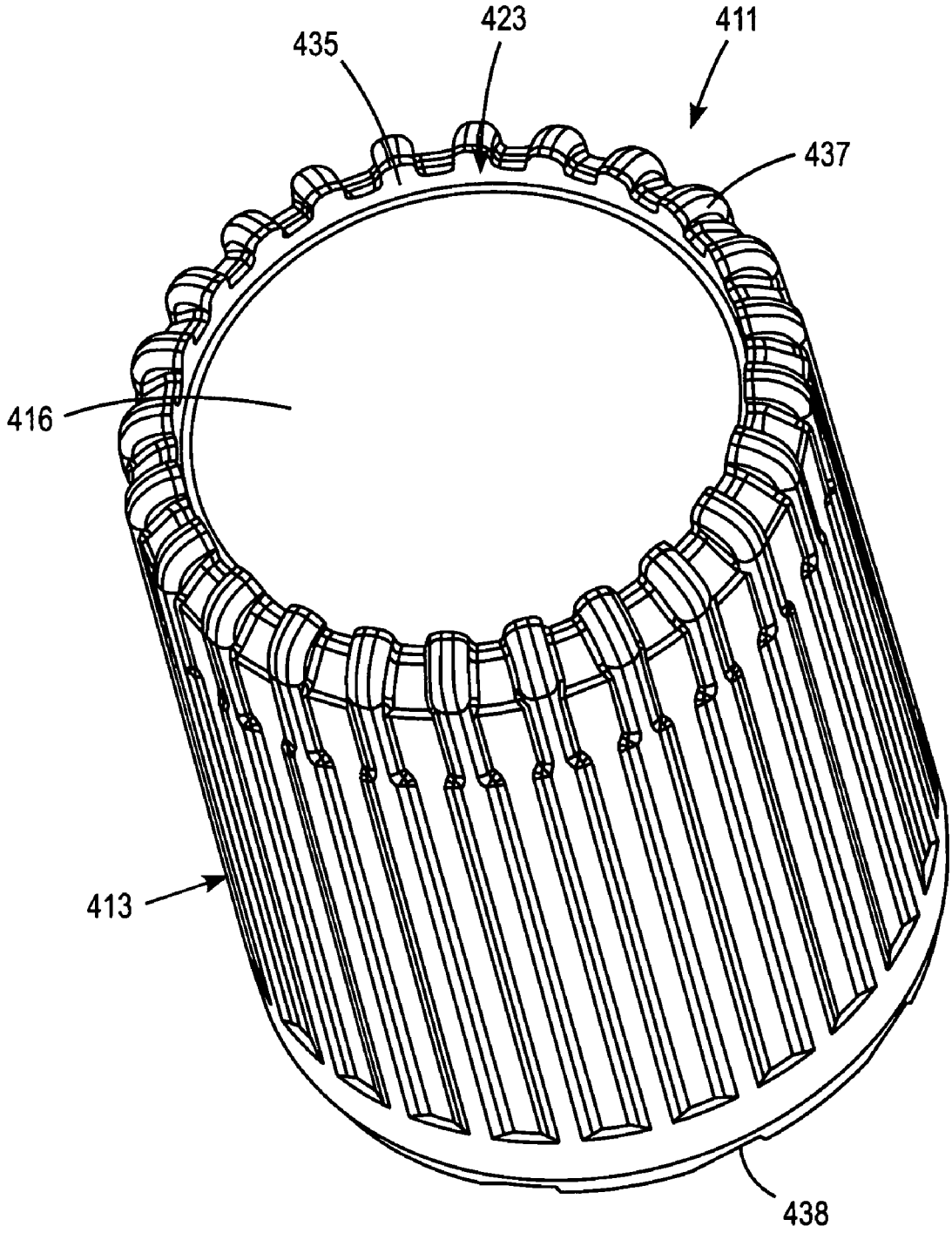
FIG. 8A is a perspective top view of a pierceable cap with two frangible layers with a slightly recessed upper frangible layer.
Figure 8B:
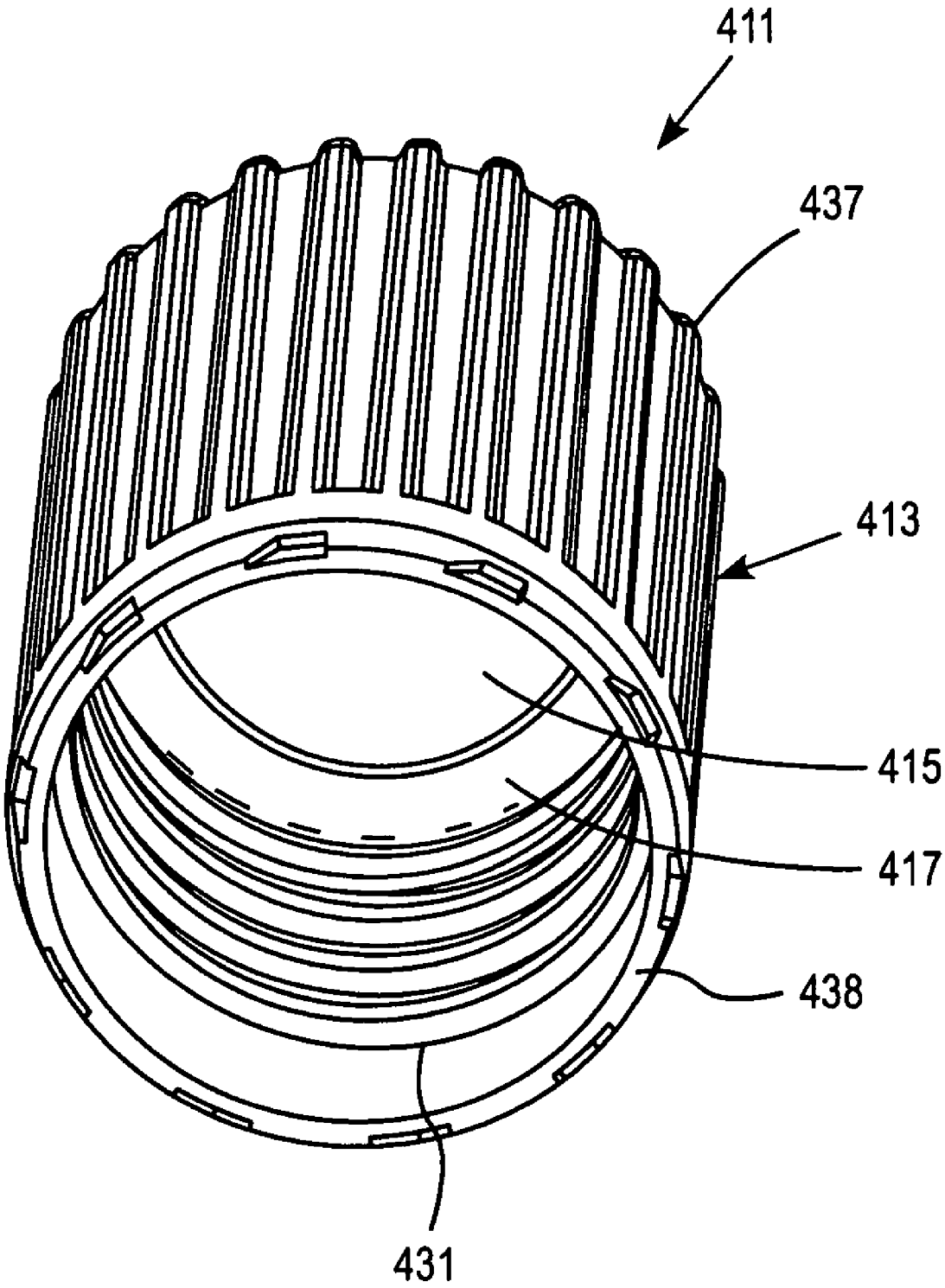
FIG. 8B is a perspective bottom view of the pierceable cap of FIG. 8A.
Figure 8C:
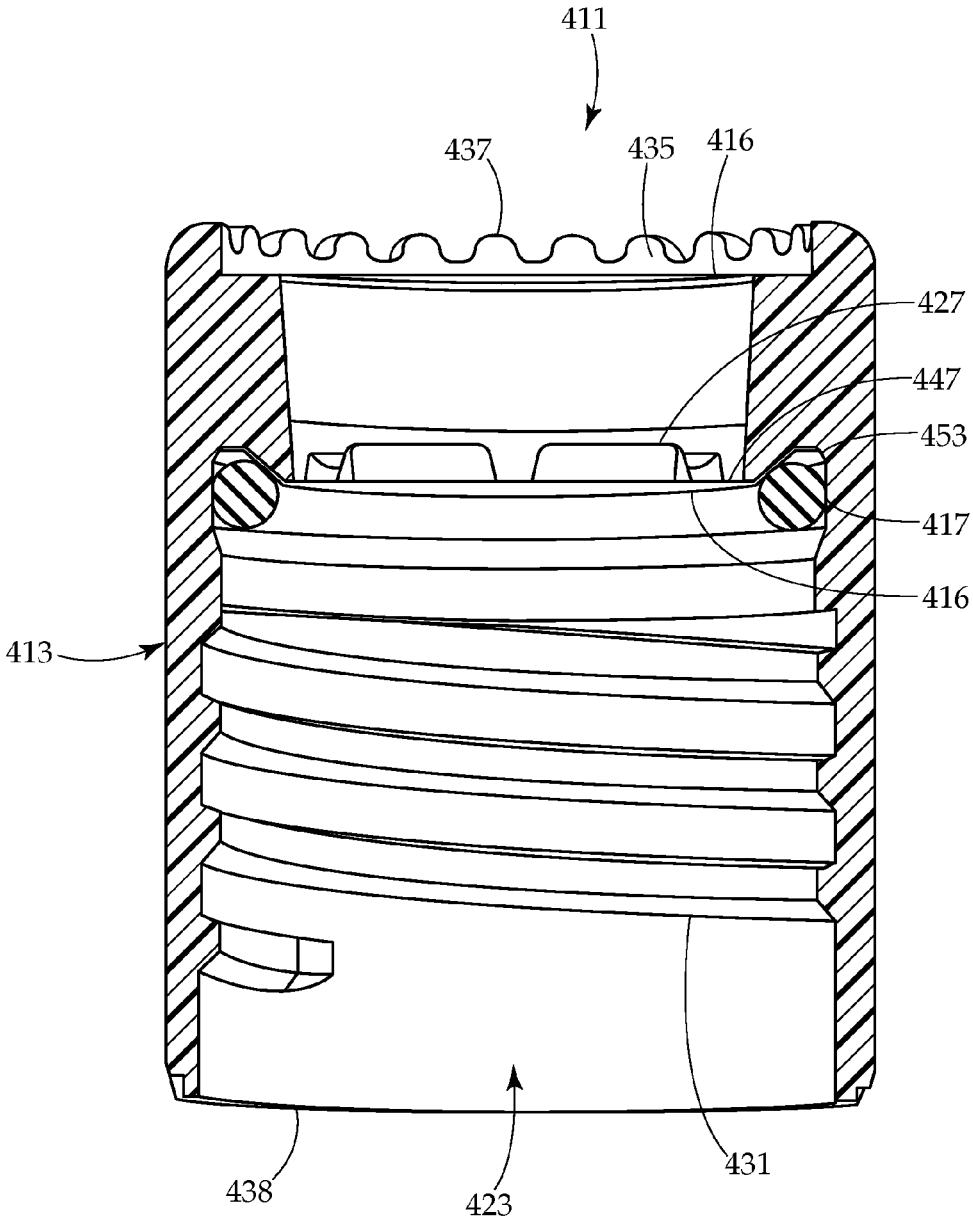
FIG. 8C is a cross sectional view of the pierceable cap of FIG. 8A.
Figure 8D:
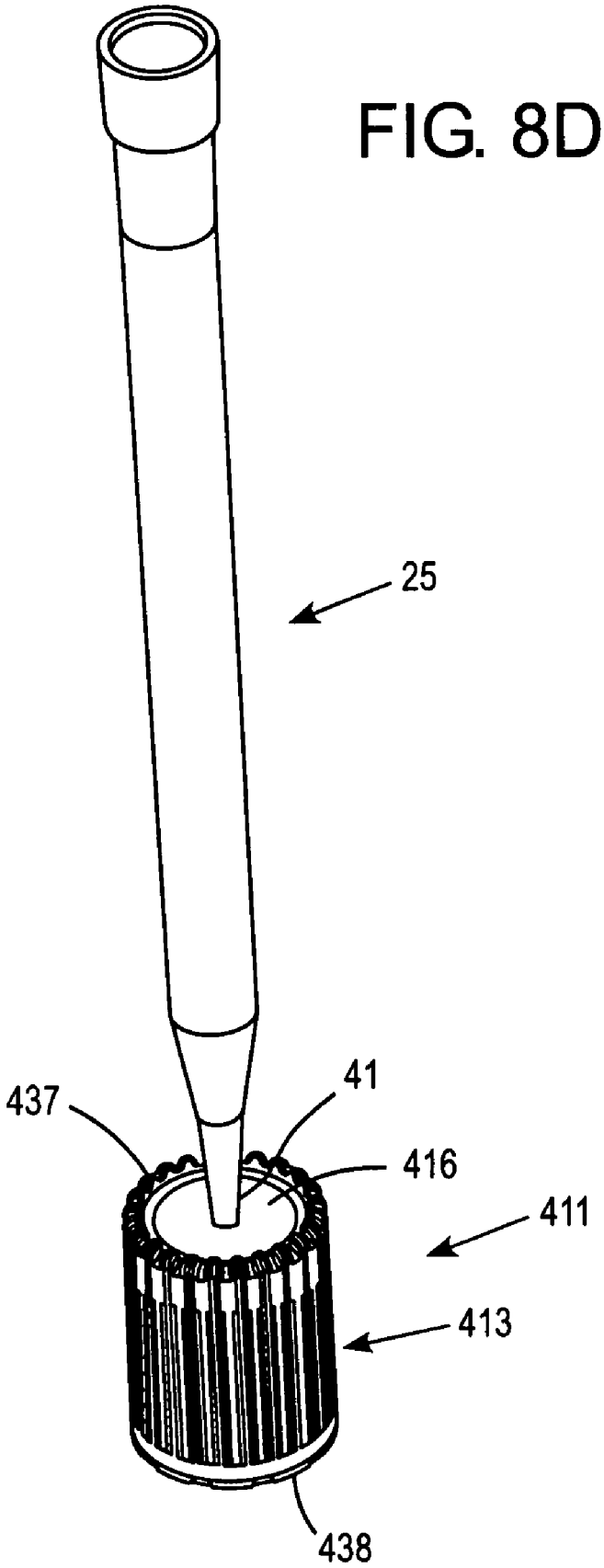
FIG. 8D is a perspective view of the pierceable cap of FIG. 8A with a pipette tip inserted through the two frangible layers.
Figure 8E:
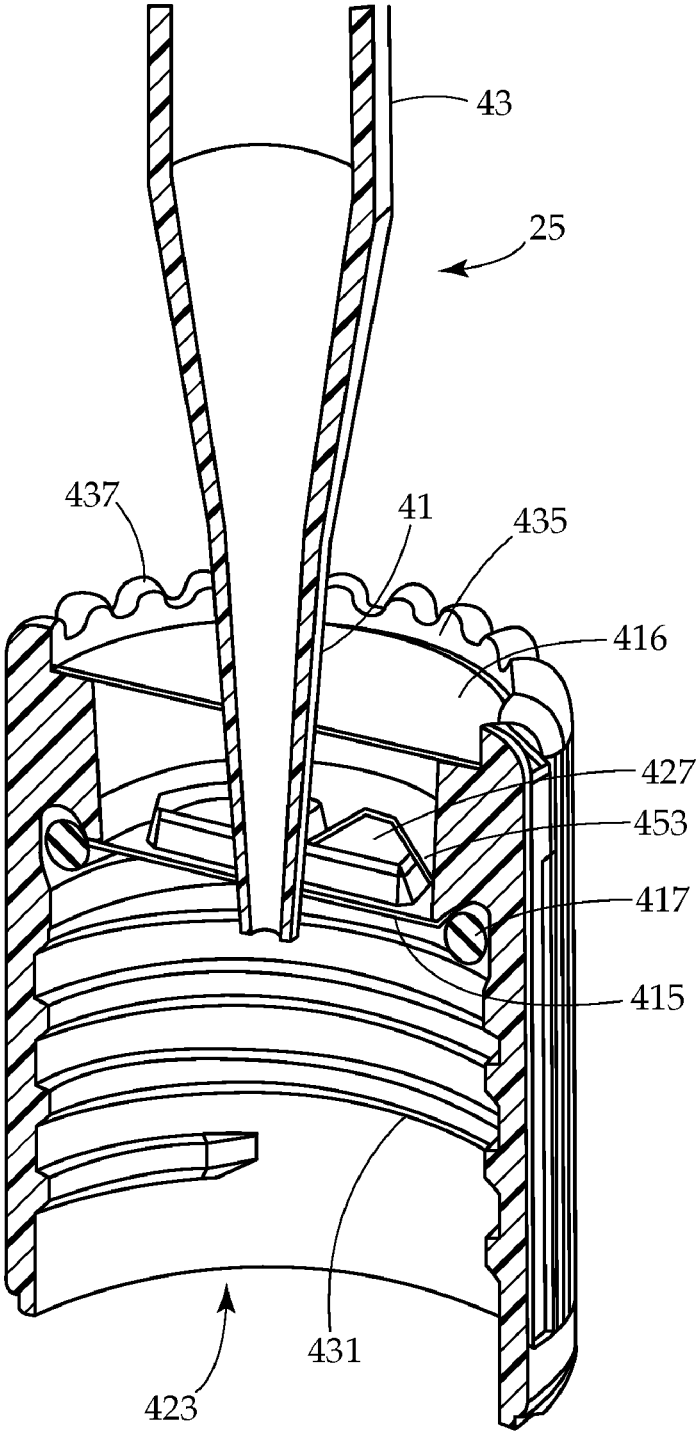
FIG. 8E is a cross sectional view of the pierceable cap of FIG. 8A with a pipette tip inserted through the two frangible layers.

FIGS. 7A-7C show an alternative pierceable cap 311 with a V-shaped frangible layer 315 with a seal 317. The frangible layer 315 maybe weakened in various patterns along a seal 317. In preferred embodiments of the present invention the seal 317 is sinusoidal in shape. The seal 317 may be linear or other shapes depending on particular uses. A sinusoidal shape seal 317 may improve sealing around a tip 41 of a transfer device 25 or may improve resealing qualities of the seal after removal of the transfer device 25 from the V-shaped frangible layer 315. Any partial resealing of the seal 317 may prevent contamination or improve storage of the contents of a vessel 21. Furthermore, a sinusoidal shape seal 317 may allow venting of the air within the vessel 21 during transfer of the contents of the vessel 21 with a transfer device 25. The frangible layer 315 maybe weakened by scoring or perforating the frangible layer 315 to ease insertion of the transfer device 25. Alternatively, the frangible layer 315 maybe constructed such that the seal 317 is thinner than the surrounding material in the frangible layer 315.

The pierceable cap 311 may include a shell 313, threads 319, and other components similar to those embodiments described above. Where not specified, the operation and components of the alternative cap 311 can include embodiments similar to those described above.

One or more additional frangible layers maybe added to the pierceable cap 311 to further prevent contamination. For example, one or more additional frangible layers maybe disposed closer to a top 321 of the shell 313 within an exterior recess (not shown). The V-shaped frangible seal 315 maybe recessed within the shell 313 such that an upper frangible seal is added above the V-shaped frangible seal 315. Alternatively, an additional frangible layer maybe flush with the top 321 of the shell 313. The operation and benefits of the upper frangible seal are discussed above.

FIG. 8A-8E show an alternative cap 411 with multiple frangible layers 415, 416. The pierceable cap 411 may include a shell 413, a lower frangible layer 415, one or more upper frangible layers 416, and, optionally, a gasket 417. Where not specified, the operation and components of the alternative cap 411 are similar to those described above.

The shell 413 maybe generally cylindrical in shape or any other shape suitable for covering an opening 19 of a vessel 21 as described above. The shell 413 of the alternative cap 411 may include provisions for securing two or more frangible layers. The following exemplary embodiment describes a pierceable cap 411 with a lower frangible layer 415 and an upper frangible layer 416, however, it is anticipated that more frangible layers maybe used disposed in series above the lower frangible layer 415.

The frangible layers 415, 416 maybe located within an access port 423. The lower frangible layer 415 is generally disposed as described above. Preferably, the access port 423 is an opening through the shell 413 from a top end 437 of the shell 413 to an opposite, bottom end 438 of the shell 413. If the shell 413 is roughly cylindrical, then the access port 423 may pass through the ends of the roughly cylindrical shell 413. The access port 423 may also be roughly cylindrical and maybe concentric with a roughly cylindrical shell 413.

The frangible layers 415, 416 maybe disposed within the access port 423 such that transfer of the sample specimen through the access port is reduced or eliminated. The frangible layers 415, 416 maybe similar to those described above. In preferred embodiments of the present invention, the foil maybe a composite of several types of materials. The same or different selected materials maybe used in the upper frangible layer 416 and the lower frangible layer 415. Furthermore, the upper frangible layer 416 and the lower frangible layer 425 may have the same or different diameters. The frangible layers 415, 416 maybe bonded to the cap by a thermal process such as induction heating or heat sealing.

A peripheral groove 453 maybe molded into the shell 413 to secure the lower frangible layer 415 in the pierceable cap 411 and/or to retain the lower frangible layer 415 in the cap 411 when the lower frangible layer 415 is pierced. The peripheral groove 453 in the cap 411 may prevent the lower frangible layer 415 from being pushed down into the vessel 21 by a transfer device 25. One or more pre-formed scores or slits may be disposed in the lower frangible layer 415 or the upper frangible layer 416.

The one or more upper frangible layers 416 maybe disposed within the shell 413 such that one or more extensions 427 are located between the lower frangible layer 415 and the upper frangible layer 416. Preferably, the distance between the lower frangible layer 415 and the upper frangible layer 416 is as large as possible. The distance may vary depending on several factors including the size of the transfer device. Preferably, the upper frangible layer 416 is only slightly recessed from the top end 437. The upper frangible layer 416 may block any jetted liquid upon puncture of the lower frangible layer 415. Preferably, no venting is associated with the upper frangible layer 416, however, venting could be used depending on particular applications.

The upper frangible layer 416 preferably contacts the conical tip 41 of a transfer device 25 during puncture of the lower frangible layer 415. The upper frangible layer 416 may be breached before the breaching of the lower frangible layer 415. The frangible layers 415, 416 maybe breached during insertion of a transfer device 25 into the access port 423. Breaching of the frangible layers 415, 416 may include piercing, tearing open or otherwise destroying the structural integrity and seal of the frangible layers 415, 416. The lower frangible layer 415 maybe breached by a movement of one or more extensions 427 around or along a coupling region 447 toward a well 29 in the vessel 21. The lower frangible layer 415 maybe disposed between the one or more extensions 427 and the vessel 21 when the one or more extensions 427 are in an initial position.

A gasket 417 maybe an elastomeric ring between the lower frangible layer 415 and the opening 19 of the vessel 21 for preventing leakage before the frangible layers 415, 416 are broken.

An exterior recess 435 at a top 437 of the pierceable cap 411 maybe disposed to keep wet surfaces out of reach of a user's fingers during handling. Surfaces of the access portal 423 may become wet with portions of the sample specimen during transfer. The exterior recess 435 may reduce or eliminate contamination by preventing contact by the user or automated capping/de-capping instruments with the sample specimen during a transfer. The exterior recess 435 may offset the frangible layers 415, 416 away from the top end 437 of the cap 411 towards the bottom end 438 of the cap 411.

The shell 413 may include screw threads 431 or other coupling mechanisms for joining the cap 411 to the vessel 15 as described above.

The operation of the pierceable cap 411 is similar to those embodiments described above.

Embodiments of the present invention can utilize relatively stiff extensions in combination with relatively fragile frangible layers. Either the frangible layer and/or the stiff extensions can be scored or cut; however, embodiments where neither is scored or cut are also contemplated. Frangible materials by themselves may not normally open any wider than a diameter of the one or more piercing elements. In many situations, the frangible material may remain closely in contact with a shaft of a transfer device. This arrangement may provide inadequate venting for displaced air. Without adequate airways or vents a transferred volume may be inaccurate and bubbling and spitting of the tube contents may occur. Stiff components used alone to seal against leakage can be hard to pierce, even where stress lines and thin wall sections are employed to aid piercing. This problem can often be overcome, but requires additional costs in terms of quality control. Stiff components may be cut or scored to promote piercing, but the cutting and scoring may cause leakage. Materials that are hard to pierce may result in bent tips on transfer devices and/or no transfer at all. Combining a frangible component with a stiff yet moveable component may provide both a readily breakable seal and adequate airways or vents to allow accurate transfer of a sample specimen without contamination. In addition, in some embodiments, scoring of the frangible layer will not align with the scoring of the still components. This can most easily be forced by providing a frangible layer and stiff components that are self aligning.

Furthermore, changing the motion profile of the tip of the transfer device during penetration may reduce the likelihood of contamination. Possible changes in the motion profile include a slow pierce speed to reduce the speed of venting air. Alternative changes may include aspirating with the pipettor or similar device during the initial pierce to draw liquid into the tip of the transfer device.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention maybe used in conjunction with other embodiments, even if not explicitly stated above.

The invention claimed is:

1. A pierceable cap comprising:

a shell, an access port in the shell for allowing passage of at least part of a transfer device through the access port, wherein the transfer device transfers a sample specimen, a lower frangible layer disposed across the access port for preventing transfer of the sample specimen through the access port prior to insertion of the at least part of the transfer device, wherein the lower frangible layer comprises a peripheral groove for securing the lower frangible layer within the shell, one or more upper frangible layers disposed across the access port for preventing transfer of the sample specimen through the access port after insertion of the at least part of the transfer device through the lower frangible layer, one or more extensions between the lower frangible layer and the one or more upper frangible layers, and wherein the one or more extensions move and pierce the lower frangible layer upon application of pressure from the transfer device.

2. The pierceable cap of claim 1, wherein the lower frangible layer is coupled to the one or more extensions.

3. The pierceable cap of claim 1, wherein the one or more upper frangible layers contact a conical tip of a transfer device during a breach of the lower frangible layer.

4. The pierceable cap of claim 1, wherein the one or more upper frangible layers are vented.

5. The pierceable cap of claim 4, wherein the one or more upper frangible layers comprise peripheral vents.

6. The pierceable cap of claim 1, wherein the one or more upper frangible layers and the lower frangible layer are foil.

7. The pierceable cap of claim 1, wherein the one or more upper frangible layers and the lower frangible layer are constructed of the same material and have the same dimensions.

8. The pierceable cap of claim 1, wherein the one or more upper frangible layers further comprise pre-formed scoring.

9. The pierceable cap of claim 1, wherein the lower frangible layer further comprises pre-formed scoring.

10. The pierceable cap of claim 1, further comprising an exterior recess within the access port and between a top of the shell and the one or more extensions.

11. The pierceable cap of claim 10, wherein the one or more upper frangible layers are offset from the top of the shell.

12. The pierceable cap of claim 1, wherein the one or more upper frangible layers are flush with a top of the shell.

13. The pierceable cap of claim 1, further comprising a gasket for securing the lower frangible layer within the shell and creating a seal between the pierceable cap and a vessel.

14. The pierceable cap of claim 1, wherein the movement of the one or more extensions creates airways for allowing air to move through the access port.

15. The pierceable cap of claim 14, wherein the one or more upper frangible layers comprise peripheral vents for the air moving through the access port.

16. A pierceable cap comprising:

a shell, an access port through the shell, a lower frangible layer disposed across the access port, an upper frangible layer disposed across the access port, wherein the access port is flush with a top of the shell, and one or more extensions between the lower frangible layer and the upper frangible layer, wherein the one or more extensions are coupled to walls of the access port by one or more coupling regions.

17. The pierceable cap of claim 16, wherein the lower frangible layer is coupled to the one or more extensions.

18. The pierceable cap of claim 16, wherein the one or more upper frangible layers contact a conical tip of a transfer device during a breach of the lower frangible layer.

19. The pierceable cap of claim 16, wherein the one or more upper frangible layers are vented.

20. The pierceable cap of claim 19, wherein the one or more upper frangible layers are peripherally vented.

21. The pierceable cap of claim 16, wherein the one or more upper frangible layers are offset from the top of the shell.

22. A pierceable cap comprising:

a shell, an access port in the shell for allowing passage of at least part of a transfer device through the access port, wherein the transfer device transfers a sample specimen, a lower frangible layer disposed across the access port for preventing transfer of the sample specimen through the access port prior to insertion of the at least part of the transfer device, wherein the lower frangible layer comprises pre-formed scoring, one or more upper frangible layers disposed across the access port for preventing transfer of the sample specimen through the access port after insertion of the at least part of the transfer device through the lower frangible layer, one or more extensions between the lower frangible layer and the one or more upper frangible layers, and wherein the one or more extensions move and pierce the lower frangible layer upon application of pressure from the transfer device.

23. A pierceable cap comprising:

a shell, an access port in the shell for allowing passage of at least part of a transfer device through the access port, wherein the transfer device transfers a sample specimen, a lower frangible layer disposed across the access port for preventing transfer of the sample specimen through the access port prior to insertion of the at least part of the transfer device, one or more upper frangible layers disposed across the access port for preventing transfer of the sample specimen through the access port after insertion of the at least part of the transfer device through the lower frangible layer, wherein the one or more upper frangible layers are flush with a top of the shell one or more extensions between the lower frangible layer and the one or more upper frangible layers, and wherein the one or more extensions move and pierce the lower frangible layer upon application of pressure from the transfer device.

24. The pierceable cap of claim 5, wherein the peripheral vents are separated by spacers.

25. The pierceable cap of claim 14 further comprising venting means.

* * * * *

UNITED STATES PATENT AND TRADEMARK OFFICE

CERTIFICATE OF CORRECTION

PATENT NO. : 8,387,811 B2
APPLICATION NO. : 11/979713
DATED : March 5, 2013
INVENTOR(S) : Dwight Livingston, Dustin Diemert and Ammon David Lentz It is certified that error appears in the above-identified patent and that said Letters Patent is hereby corrected as shown below:

On the Title Page

Item (57) Abstract, Lines 1 & 7, delete "maybe" and insert --may be--.

Signed and Sealed this
Third Day of February, 2015

Michelle K. Lee

Michelle K. Lee
*Deputy Director of the United States Patent and Trademark Office*